US007539286B1

(12) United States Patent
Bandy et al.

(10) Patent No.: US 7,539,286 B1
(45) Date of Patent: May 26, 2009

(54) FILAMENT ASSEMBLY HAVING REDUCED ELECTRON BEAM TIME CONSTANT

(75) Inventors: Steve Bandy, Sunnyvale, CA (US); Gary F Virshup, Cupertino, CA (US); Michael Curzon Green, Palo Alto, CA (US); James Russell Boye, Salt Lake City, UT (US); Dennis Runnoe, Salt Lake City, UT (US); Robert Clark Treseder, Lynchburg, VA (US); David Humber, Los Gatos, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 11/942,656

(22) Filed: Nov. 19, 2007

(51) Int. Cl.
*H01J 35/06* (2006.01)

(52) U.S. Cl. ..... 378/136; 378/121

(58) Field of Classification Search ..... 378/119, 378/121, 134, 136; 313/306, 341, 343, 344, 313/450, 454, 620, 621
See application file for complete search history.

(56) References Cited

U.S. PATENT DOCUMENTS 3,737,706 A * 6/1973 Lindburg et al. ..... 313/522
4,065,689 A * 12/1977 Pleil ..... 378/134
4,823,371 A * 4/1989 Grady ..... 378/138
6,333,969 B1 * 12/2001 Kujirai ..... 378/138

* cited by examiner

*Primary Examiner*—Courtney Thomas
(74) *Attorney, Agent, or Firm*—Workman Nydegger

(57) ABSTRACT

A filament assembly for use in an x-ray emitting device or other filament-containing device is disclosed. In one embodiment, an x-ray tube is disclosed, including a vacuum enclosure that houses both an anode having a target surface, and a cathode positioned with respect to the anode. The cathode includes a filament assembly for emitting a beam of electrons during tube operation. The filament assembly comprises a heat sink and a plurality of filament segments. The filament segments are configured for simultaneous emission of an electron beam for impingement on the target surface of the anode, and are electrically connected in series. Each filament segment includes first and second end portions that are thermally connected to the heat sink, and a central portion that can be configured with a modified work function for preferential electron emission.

59 Claims, 23 Drawing Sheets

FILAMENT ASSEMBLY HAVING REDUCED ELECTRON BEAM TIME CONSTANT

BACKGROUND

1. Technology Field

The present invention generally relates to x-ray tube devices and other filament-containing devices.

2. The Related Technology

X-ray generating devices are extremely valuable tools that are used in a wide variety of applications, both industrial and medical. Such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, and then impinged upon a material of a particular composition. This process typically takes place within an x-ray tube located in the x-ray generating device. The x-ray tube generally comprises a vacuum enclosure that contains a cathode and an anode. The cathode typically includes a filament structure for emitting electrons that are then received by the anode.

The vacuum enclosure may be composed of metal such as copper, glass, ceramic, or a combination thereof, and is typically disposed within an outer housing. At least a portion of the outer housing might be covered with a shielding layer (composed of, for example, lead or similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits.

In operation, an electric current is supplied to the cathode filament, causing it to emit a stream of electrons by virtue of a process known as thermionic emission. An electric potential is established between the cathode and anode, which causes the electron stream to gain kinetic energy and accelerate toward a target surface disposed on the anode. Upon impingement at the target surface, some of the resulting kinetic energy in converted to electromagnetic radiation of very high frequency, i.e., x-rays.

The specific frequency of the x-rays produced depends at least partially on the type of material used to form the anode target surface. Target surface materials having high atomic numbers ("Z numbers"), such as tungsten or tungsten rhenium, might be employed, although depending on the application, other materials could also be used. The resulting x-rays can be collimated so that they exit the x-ray device through predetermined regions of the vacuum enclosure and outer housing for entry into the x-ray subject, such as a medical patient.

One challenge encountered with the operation of x-ray tubes relates to the speed with which the stream of electrons produced by the filament of the cathode can be turned on and off, commonly referred to as "switching time." Though advantageous for accurately controlling the electron stream and hence the production of x-rays, it has been traditionally difficult to achieve relatively fast filament switching times due to a number of factors, most prevalently, the thermal response—also referred to herein as the "thermal time constant"—of the filament. Briefly, the thermal time constant is a measure of the time required for the filament to cool to a predetermined temperature. The thermal time constant is directly related to the "time constant," or measure of time required for the filament to reduce electron emission to a predetermined level. As can be determined from the above, the time constant and switching time of the filament are closely related. Thus, a relatively short time constant corresponds to a desirable fast switching time.

The current design of known filaments does not easily provide for the reduction of switching times. One approach involves the inclusion of a third filament electrode, commonly called a grid, for use in modulating the electron beam emission. While acceptably lowering filament switching times, grids nevertheless carry with them some undesirable consequences. Apart from the extra grid lead and power supply needed to power it, one chief consequence of grid use is the increased risk of electrical arcing from tube structures to the grid itself. This can be particularly acute in tubes utilizing high voltages, and can result in damage to the tube.

Other attempts to acceptably switch and modulate the emitted electron beam, also referred to herein as "beam current," include the heating of a low thermal mass emitter by an electron beam, or modulation of the electron beam by modulating the electric potential imparted to the anode. However, these options also suffer from a relative increase of the risk for arcing within the tube.

BRIEF SUMMARY

Disclosed embodiments of the present invention have been developed in response to the above and other needs in the art. Briefly summarized, embodiments of the present invention are directed to filament assemblies for use in an x-ray emitting device or other filament-containing device. The disclosed assemblies provide for a relatively reduced thermal time constant during filament operation, which results in a net reduction in filament switching time.

In one embodiment, an x-ray tube is disclosed, including a vacuum enclosure that houses both an anode having a target surface, and a cathode positioned with respect to the anode. The cathode includes a filament assembly for emitting a beam of electrons during tube operation. The filament assembly includes a heat sink and a plurality of filament segments. The filament segments are configured for simultaneous emission of an electron beam for impingement on the target surface of the anode, and are electrically connected in series. In disclosed embodiments, each filament segment includes first and second end portions that are in thermal communication with the heat sink, and a central portion having a modified work function for preferential electron emission.

In another disclosed embodiment, a filament assembly includes first and second heat sinks and a plurality of filament segments. The filament segments are each thermally connected in parallel to both heat sinks, and the filament segments are configured to simultaneously emit an electron beam for impingement on the anode target surface. In accordance with this embodiment, the filament segments feature parallel thermal dissipation paths, which assist in reducing the thermal time constant.

In yet another embodiment, a filament assembly is disclosed, having a heat sink that defines a plurality of slots, and a plurality of filament segments that are partially disposed within corresponding slots. The filament segments are configured for simultaneous emission of a beam of electrons. Each filament segment includes first and second end portions that are in thermal communication with the heat sink, and a central portion that is interposed between the first and second end portions. In one disclosed embodiment, the filament segments can be defined from a single continuous strand of conductive wire that is shaped in a step ladder configuration. Alternatively, each filament segment can be defined from a discrete conductive member such that the filament segments are arranged to be electrically in parallel with one another. Optionally, thermal communication between a filament segment and the heat sink can be enhanced by way of, for example, a braze material.

Measures are also disclosed for controlling the effects of utilizing plural filament segments in the present filament assembly. Particularly, to counteract increased power dissipation and reduced electrical impedance as a result of its design, embodiments of the filament assembly might include filament segment wires having a reduced cross sectional diameter. The reduced wire diameter controls power dissipation in the filament assembly. In addition, the filament segment wires, composed in one embodiment of thoriated tungsten, can be carburized so as to further control power dissipation in the filament assembly. These measures also desirably improve the electrical impedance of the system, making the filament assembly feasible for general use.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-18 depict various features of embodiments of the present invention, which is generally directed to a filament assembly for use in an x-ray emitting device or other filament-containing device. Embodiments of the disclosed filament assembly provide for a relatively reduced thermal time constant, which in turn reduces the filament time constant. Advantageously, this results in a net reduction in the switching time required to vary the current of a beam of electrons emitted by the assembly during device operation. As used herein, "filament" is understood to include a conductive emitter that is capable of emitting electrons during use.

Figure 1:
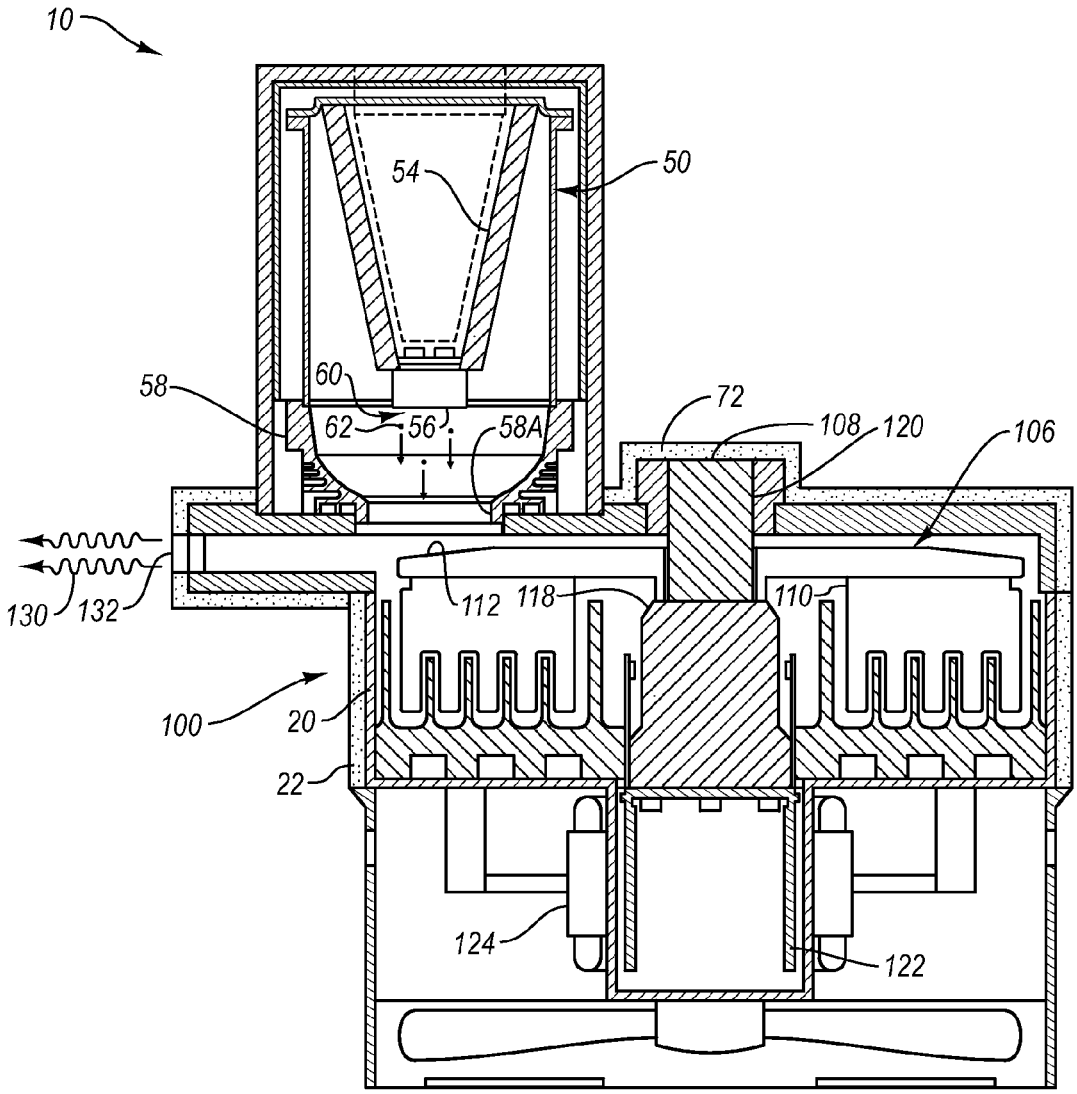
FIG. 1 is a cross sectional side view of an x-ray tube that serves as one possible environment for inclusion of the present invention, according to one embodiment.

Reference is first made to FIG. 1, which depicts one possible environment wherein embodiments of the present invention can be practiced. Particularly, FIG. 1 shows an x-ray tube, designated generally at 10, which serves as one example of an x-ray generating device. The x-ray tube 10 generally includes an evacuated enclosure 20 that houses a cathode assembly 50 and an anode assembly 100. The evacuated enclosure 20 defines and provides the necessary envelope for housing the cathode and anode assemblies 50, 100 and other critical components of the tube 10 while providing the shielding and cooling necessary for proper x-ray tube operation. The evacuated enclosure 20 further includes shielding 22 that is positioned so as to prevent unintended x-ray emission from the tube 10 during operation. Note that, in other embodiments, the x-ray shielding is not included with the evacuated enclosure, but rather might be joined to a separate outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. While other configurations could be used, in the illustrated example the cathode assembly 50 includes a support structure 54 that supports a cathode head 56. In the example of FIG. 1, a cathode aperture shield 58 defines an aperture 58A that is positioned between an electron-producing filament assembly, generally designated at 60 and described in further detail below, and the anode 106 to allow electrons 62 emitted from the filament assembly to pass. The aperture shield 58 in one embodiment can be cooled by a cooling fluid as part of a tube cooling system (not shown) in order to remove heat that is created in the aperture shield as a result of errant electrons impacting the aperture shield surface. FIG. 1 is representative of one example of an environment in which the disclosed filament assembly might be utilized. However, it will be appreciated that there are many other x-ray tube configurations and environments for which embodiments of the filament assembly would find use and application.

As mentioned, the cathode head 56 includes the filament assembly 60 as an electron source for the production of the electrons 62 during tube operation. As such, the filament assembly 60 is appropriately connected to an electrical power source (not shown) to enable the production by the assembly of the high-energy electrons 62.

The illustrated anode assembly 100 includes an anode 106, and an anode support assembly 108. The anode 106 comprises a substrate 110 preferably composed of graphite, and a target surface 112 disposed thereon. The target surface 112, in one example embodiment, comprises tungsten or tungsten rhenium, although it will be appreciated that depending on the application, other "high" Z materials/alloys might be used. A predetermined portion of the target surface 112 is positioned such that the stream of electrons 62 emitted by the filament assembly 60 and passed through the shield aperture 58A impinge on the target surface so as to produce the x-rays 130 for emission from the evacuated enclosure 20 via an x-ray transmissive window 132.

The production of x-rays described herein can be relatively inefficient. The kinetic energy resulting from the impingement of electrons on the target surface also yields large quantities of heat, which can damage the x-ray tube if not dealt with properly. Excess heat can be removed by way of a number of approaches and techniques. For example, in the disclosed embodiment a coolant is circulated through designated areas of the anode assembly 100 and/or other regions of the tube. Again, the structure and configuration of the anode assembly can vary from what is described herein while still residing within the claims of the present invention.

In the illustrated example, the anode 106 is supported by the anode support assembly 108, which generally comprises a bearing assembly 118, a support shaft 120, and a rotor sleeve 122. The support shaft 120 is fixedly attached to a portion of the evacuated enclosure 20 such that the anode 106 is rotatably disposed about the support shaft via the bearing assembly 118, thereby enabling the anode to rotate with respect to the support shaft. A stator 124 is circumferentially disposed about the rotor sleeve 122 disposed therein. As is well known, the stator utilizes rotational electromagnetic fields to cause the rotor sleeve 122 to rotate. The rotor sleeve 122 is attached to the anode 106, thereby providing the needed rotation of the anode during tube operation. Again, it should be appreciated that embodiments of the present invention can be practiced with anode assemblies having configurations that differ from that described herein. Moreover, in still other tube implementations and applications, the anode may be stationary.

Figure 2A:
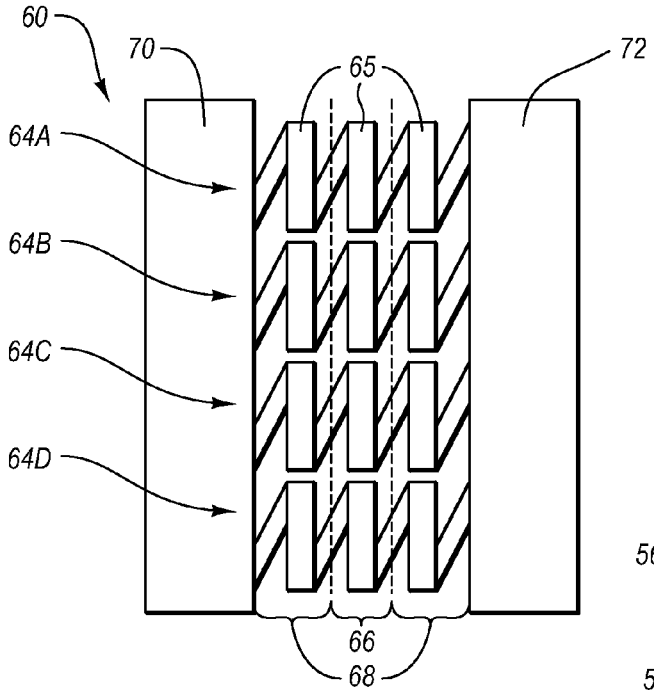
FIG. 2A is a top view of a filament assembly, according to one embodiment.
Figure 2C:
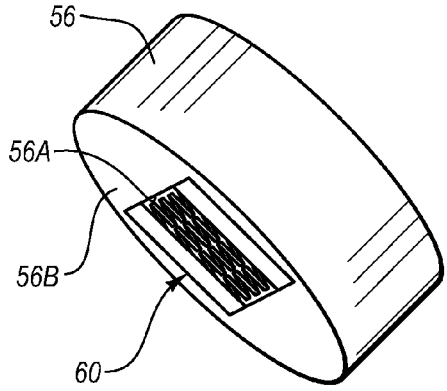
FIG. 2C is a perspective view of a portion of the filament assembly included in a portion of a cathode assembly, according to one embodiment.

Attention is now directed to FIG. 2A, wherein further details concerning embodiments of the filament assembly 60 are given. As shown, in this example the filament assembly 60 includes a plurality of filament segments configured for the emission of electrons (denoted at 62 in FIG. 1) during tube operation. In this embodiment, the filament assembly 60 includes a plurality of segments: 64A, 64B, 64C, and 64C, though it is appreciated that in other embodiments, more or fewer filament segments can be included in the assembly. As mentioned and as will be seen in FIG. 2C, the illustrated filament assembly 60 is included in a cavity 56A formed in a surface 56B of the cathode head 56, wherein the surface 56B generally faces toward the target surface 112 of the anode 106.

Each filament segment 64A-D includes a conductive wire arranged in a coiled configuration so as to each define a substantially parallel series of helical coils 65. In other embodiments, the filament segments could define other coil shapes or be composed of a conductive foil arranged in a coil. Further, while the wire of the filament segments has a round cross section in the illustrated embodiment, other cross sectional wire shapes are also contemplated.

Figure 2B:
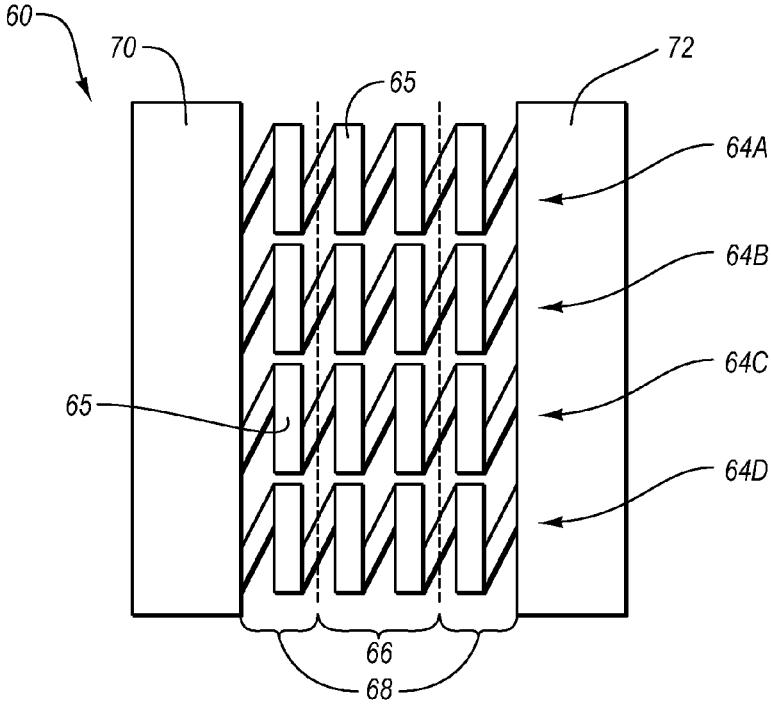
FIG. 2B is a top view of a filament assembly, according to another embodiment.

The coils 65 of each filament segment 64A-D can be divided into a central portion 66 and two end portions 68, each adjacent the central portion. In this particular embodiment, each segment 64A-D includes 3 coils, and the central and end portions 66, 68 include one coil each. As seen in FIG. 2B and as will be further discussed below, however, the number of coils included in each filament segment can vary; as such the number of coils in the respective central and end portions will correspondingly vary. Generally, at least one coil 65 in each end portion 68 is necessary so as to enable the coil(s) in the central portion 66 to heat to a temperature sufficient for thermionic emission of electrons from a respective one of the filament segments 64A-D.

In this embodiment, the filament segments 64A-D are interposed between heat sinks 70 and 72, as shown in FIG. 2A. In particular, the end portions 68 of each filament segment 64A-D are in thermal communication with the respective adjacent heat sink 70, 72 so as to provide a thermal path between each filament segment and the heat sinks. This configuration provides for the conductive dissipation of heat from either end of each filament segment 64A-D to the heat sinks. So situated, the filament segments are found in a parallel thermal configuration with respect to one another in this particular embodiment.

The filament segments 64A-D are also in electrical communication with a power source so as to enable their collective operation. In this embodiment, the filament segments 64A-D are electrically connected in parallel, though in other embodiments other connection schemes are possible, as will be described. So configured, the filament segments 64A-D operate simultaneously in producing electrons during tube operation. During such operation, it is the central portion 66 of each filament segment 64A-D that produces the electrons via thermionic emission, while the end portions 68 provide for sufficient heat buildup to occur in the central portion.

The configuration of the filament assembly 60 as shown in FIG. 2A provides enhanced filament operation over known filaments, which typically include only a single span of coiled wire. In particular, the filament assembly 60 maintains the total number of coils that emit electrons, i.e., the four coils defining the central portions 66 of the filament segments 64A-D in the embodiment shown in FIG. 2A, as would be present in a typical filament. However, by dividing the formerly lengthy single filament into a plurality of smaller filament segments as shown in FIG. 2A, the filament assembly 60 provides for enhanced heat sinking via the end portions 68 of each filament segment 64A-D into the heat sinks 70 and 72.

Figure 4:
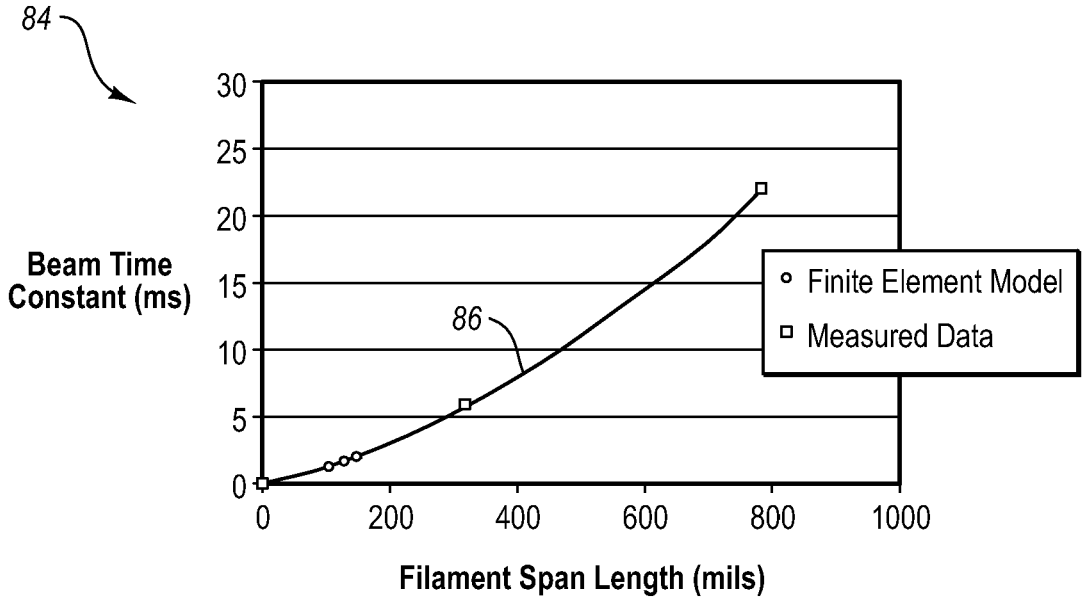
FIG. 4 is a graph demonstrating switching time improvement both modeled and realized for a filament configured in accordance with an embodiment of the present invention.

This enhanced thermal conduction correspondingly reduces the thermal time constant for each for each filament segment 64A-D, which in turn reduces each filament segment time constant. A reduction or shortening of the filament time constant equates to faster switching times for the filament segment, which simultaneously operate in unison, so as to desirably enable the stream of electrons collectively produced by the filament segments, i.e., the beam current, to be varied with minimum delay. Variance of the beam current in this manner is achieved by varying the power supply i.e., the filament current, which is provided to the filament segments 64A-D. FIG. 4 depicts a graph 84 including a curve 86 depicting example representative data showing the advantageous improvement in time constant performance (y-axis) as the filament length (x-axis) is decreased.

Generally, the number and length of the filament segments 64A-D affects the beam current produced by the filament assembly at a predetermined filament current. Thus, the number and length of the filament segments, including the size and number of coils, can be varied from what is shown in FIG. 2A, if desired. FIG. 2B shows one possible configuration of the filament assembly, wherein the filament segments 64A-D each contain four coils 65 of conductive wire, thereby resulting in relatively longer filament segments than those shown in FIG. 2A. So configured, each filament segment 64A-D includes a central portion 66 having two coils that emit electrons during operation, as well as two end portions 68 having one coil each. Of course, the number of coils defining each central and end portion can be changed from what is shown in the accompanying figures. Also, though shown here to have equal lengths and uniformly sized coils, these parameters could be varied from segment to segment in the filament assembly, if desired.

Figure 3A:
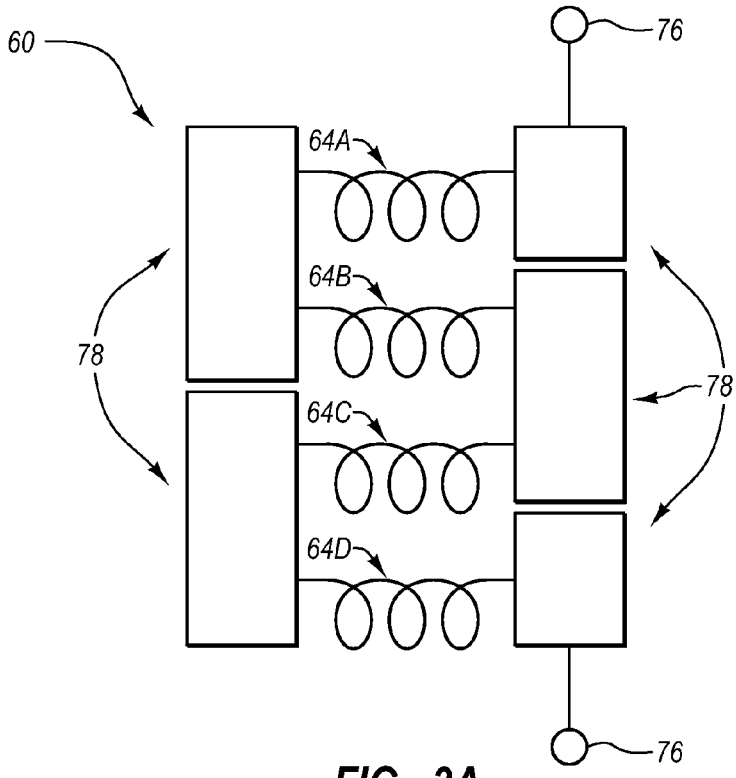
FIG. 3A is a simplified diagram of a filament assembly, according to one embodiment.

Reference is now made to FIG. 3A, which depicts in simplified form one possible thermal and electrical configuration for a filament assembly, according to one embodiment. As shown, The filament segments 64A-D are thermally connected in parallel to a plurality of conductive heat sinking interconnects 78 so as to enable heat dissipation through the end portions of each filament segment. In addition, the conductive interconnects 78 are configured so as to establish the filament segments 64A-D in series electrically with respect to one another. So configured, the electrical power supply flows between the two terminals 76, via the filament segments 64A-D in series. Compare this to the configuration in FIGS. 2A and 2B, wherein the filament segments are both thermally and electrically in parallel.

Figure 3B:
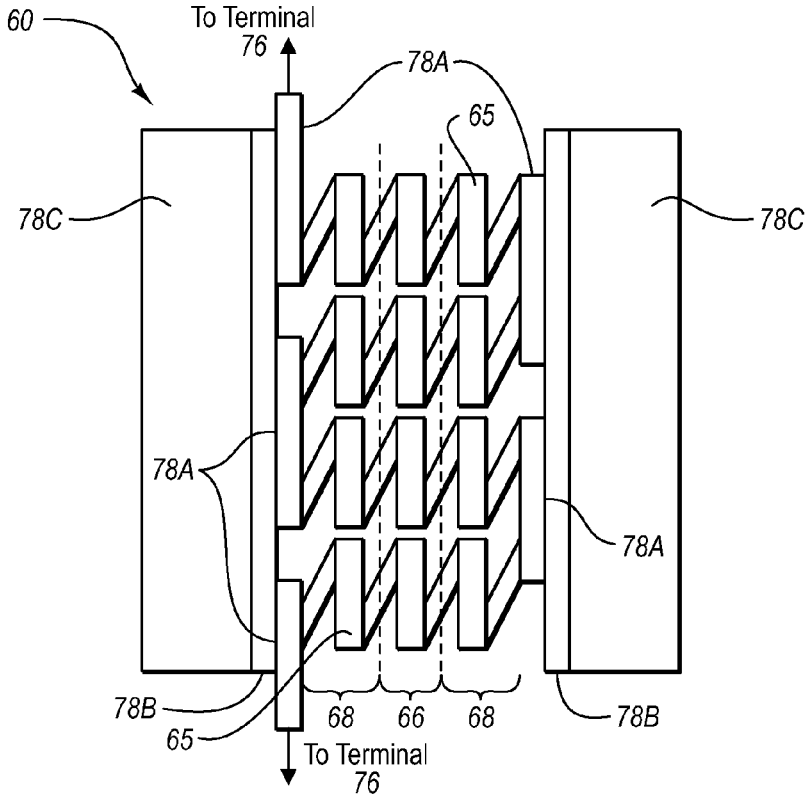
FIG. 3B is a top view of a filament assembly configured according to the design shown in FIG. 3A.

FIG. 3B shows one possible implementation of the filament assembly configuration represented in FIG. 3A. In particular, FIG. 3B shows the filament assembly 60 as including the filament segments 64A-D, as previously discussed. The end portions 68 of each filament segment 64A-D are electrically connected to electrically conductive interconnects 78A in a fashion that enables the filament segments to be electrically connected in series. In the illustrated embodiment, five such conductive interconnects 78A are shown, each interconnect electrically coupling end portions of adjacent filament segments. As in FIG. 3A, a power supply is provided to the conductive interconnects 78A. So configured, a serial electrical path is established through the filament assembly 60 via the conductive interconnects and the filament segments 64A-D.

The conductive interconnects 78A are electrically isolated from the two heat sinks 78C, between which the filament segments 64A-D extend, by two interposed insulators 78B. The insulators 78B are configured to be electrically insulating yet thermally conductive so as to confine the supplied electric current serially in the conductive interconnects 78A while enabling heat produced by the filament segments 64A-D to pass through their respective end portions 68, through the conductive interconnects, then through the insulators 78B for sinking into the heat sinks 78C via thermal conduction. In this way, the filament segments 64A-D are in parallel thermally, while being electrically connected in series. It is noted here that various other physical configurations of the filament assembly are possible to achieve the thermally parallel, electrically serial configuration described herein.

According to one embodiment, the filament segments 64A-D can be configured so as to acceptably compensate for certain effects precipitated by the filament assembly design as described herein. Specifically, reference is made to equation (1), below, defining the thermal time constant $\tau$ for a filament having a wire length L:

$$\tau = C_h L^2 / 8K, \tag{1}$$

where $C_h$ and K are the specific heat and thermal conductivity of the wire, respectively. As can be seen from equation (1), as wire length L of the filament decreases, the thermal time constant $\tau$ also decreases. In the context of the illustrated embodiments, each of the filament segments has a decreased wire length relative to longer single filaments known in the art. Thus, the use of multiple reduced-length filament segments in the filament assembly 60 beneficially results in a reduced thermal time constant relative to the use of a relatively long single filament as is known in the art. Note that increasing the thermal conductivity K of the wire also results in a reduced thermal time constant. However, higher power dissipation and lower electrical impedance for the filament assembly are also realized when implementing the filament assembly as described herein, and must be dealt with.

In one embodiment, the increase in power dissipation can be tempered by reducing the diameter/cross sectional area of the conductive wire/conductive member from which the filament segments 64A-D are formed, noting that the thermal time constant $\tau$ is independent of the wire cross section, as seen in equation (1). Reduction of the wire diameter does not negatively impact the filament segment fragility as each segment has a reduced length over known single filaments. If needed, any compromise in the size of the resultant electron beam produced by the filament assembly having reduced wire diameter filament segments can be compensated for by increasing the number of electron-emitting coils in the filament segment central portion, as is seen in FIG. 2B over FIG. 2A, for instance.

The increase in power dissipation can be further tempered other ways as well. For example, the filament segments can be modified so as to selectively alter their work function. This may be accomplished, for instance, by selectively depositing a work function-altering material on predetermined portions of the filament segments, or carburizing or otherwise converting and/or diffusing predetermined portions of the filament segments. In one non-limiting example, selected portions of each filament segment composed of a thoriated tungsten wire is carburized or otherwise treated to produce a filament segment. The carburized portions of the filament segment—preferably the central portion of each segment in one embodiment—possess a relatively lower work function than other non-carburized segment portions. It will be appreciated that any other suitable material for the filament segment might also be used. For example, lanthanum (lanthanated) tungsten and other materials might be used.

Altering the work function of the filament segments as described above causes each segment to exhibit a reduced thermal conductivity over standard tungsten, thereby reducing power loss through the filament segment. Further, the filament temperature required for electron production in the portions of the filament segments that are altered in work function is desirably reduced. Additional details regarding altering the work function of filaments can be found in U.S. application Ser. No. 11/350,975, entitled "Improved Cathode Structures for X-Ray Tubes," filed Feb. 8, 2006 (hereinafter the '975 application), which is incorporated herein by reference in its entirety.

Figure 5:
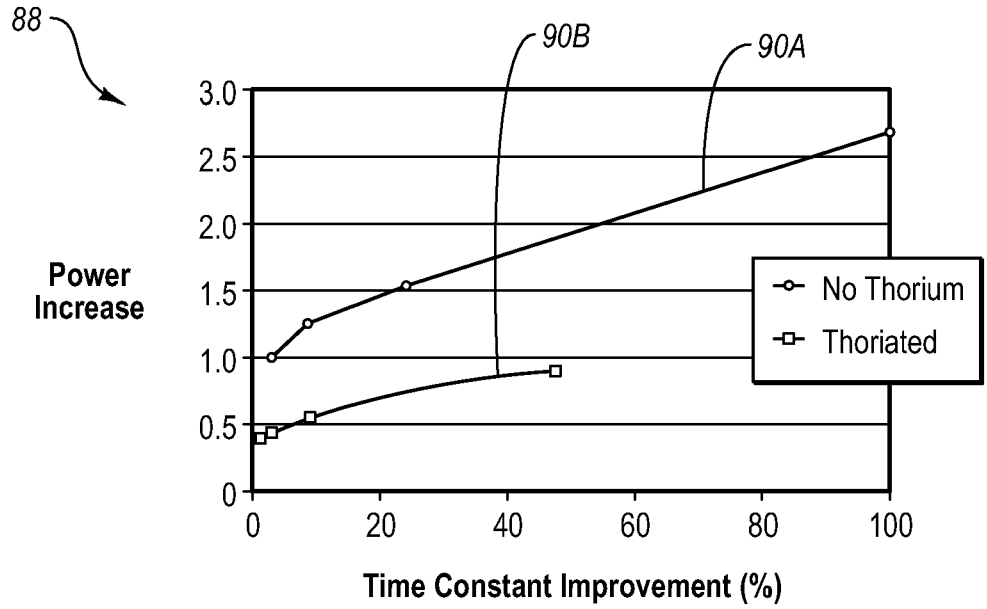
FIG. 5 is a graph demonstrating relative power increase versus time constant improvement for a filaments configured according to an embodiment of the present invention.

Accordingly, the above work function altering measures reduce the need for decreasing the filament wire diameter, enabling for example an increase in filament wire diameter from 4 to 6 mils, in one embodiment. Graph 88 shown in FIG. 5 depicts these concepts, wherein curve 90A shows the level of power increase (y-axis) as the time constant is improved without a thoriated tungsten wire filament, while curve 90B shows the reduced power increase present when a thoriated tungsten wire is used for the filament segments.

With respect to the second consequence noted above, i.e., reduced electrical impedance in the filament assembly, it is noted that reducing the filament segment wire diameter as described above will also increase electrical impedance. Further, carburizing the filament segment wire increases electrical impedance even more. Thus, the steps taken to improve power dissipation for the filament assembly 60 also desirably improve the loss of electrical impedance.

Figure 6:
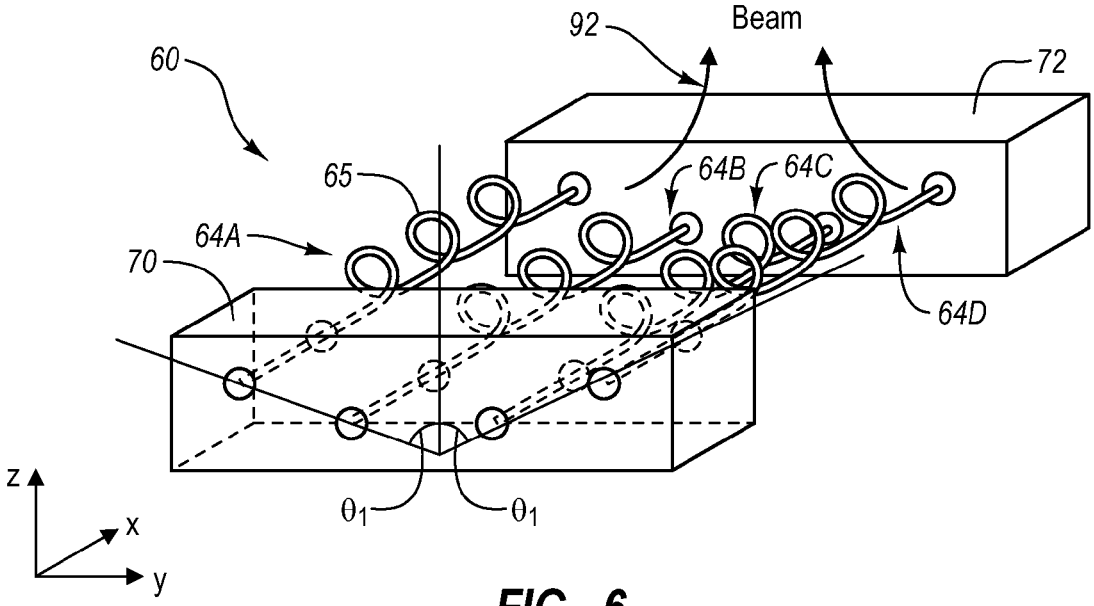
FIG. 6 is a simplified perspective view of a filament assembly showing one possible orientation of filament segments, according to one embodiment.
Figure 7:
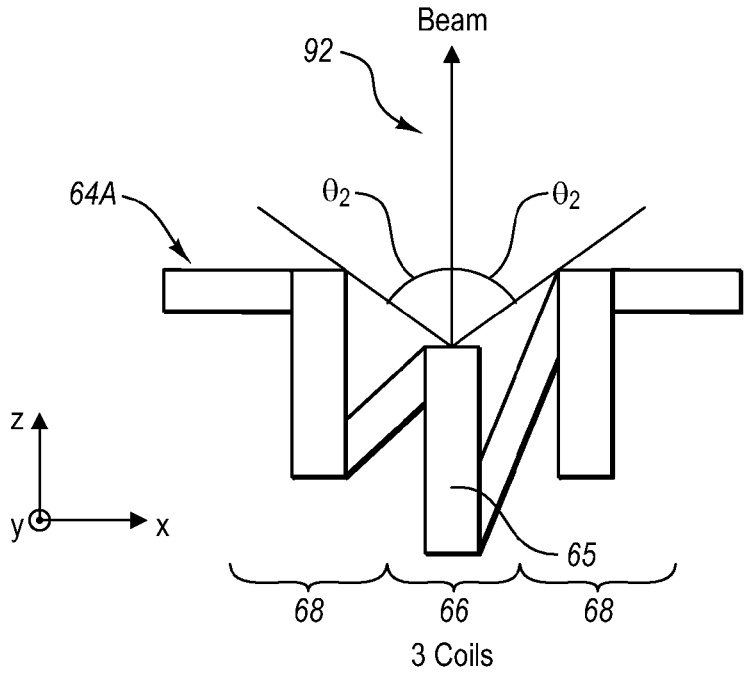
FIG. 7 is a side view of a filament segment showing one possible shaping of the filament segment, according to one embodiment of the present invention.

Reference is now made to FIGS. 6 and 7 to describe additional configurations of the filament assembly 60 that may be employed to desirably shape a beam of electrons that are emitted by the filament assembly during operation. In one embodiment, the filament segments 64A-D are arranged in an angled configuration, when viewed end on. As shown in FIG. 6, the filament segments are arranged in a chevron pattern, wherein the filament segment pair 64A and B, as well as the filament segment pair 64C and 64D, are positioned along imaginary lines that form an angle $\theta_1$ with a vertical line parallel to a z-axis shown in the figure. In one embodiment, the angle $\theta_1$ is approximately 67 degrees, commonly known as the "Pierce angle," though other values for $\theta_1$ are also possible.

Arrangement of the filament segments 64A-D in this manner advantageously produces a self-focused beam 92 of electrons in a y-z plane for travel from the filament assembly 60 in the z-direction during operation.

In FIG. 7 a representative filament segment 64A is shown, having a central portion coil 65 that is positioned so as to define an angle $\theta_2$ with adjacent end portion coils 65. In one embodiment, the angle $\theta_2$ is the Pierce angle, approximately 67 degrees, though other values for $\theta_2$ are also possible. Arrangement of the filament segment coils 65 in this manner further focuses the electron beam 92 in the x-z plane for travel from the filament assembly in the z-direction during operation.

Note that this angled coil configuration can be achieved regardless of the number of coils in the central and end portions of each filament segment, and that different angular configurations, similar to those as shown in FIGS. 6 and 7, can be included on each filament segment, if desired. In general, it should be appreciated that shaping of the filament segments in the manner shown in FIG. 7 is made possible by virtue of the relatively smaller lengths of each segment, as compared with known, longer filaments.

Figure 8A:
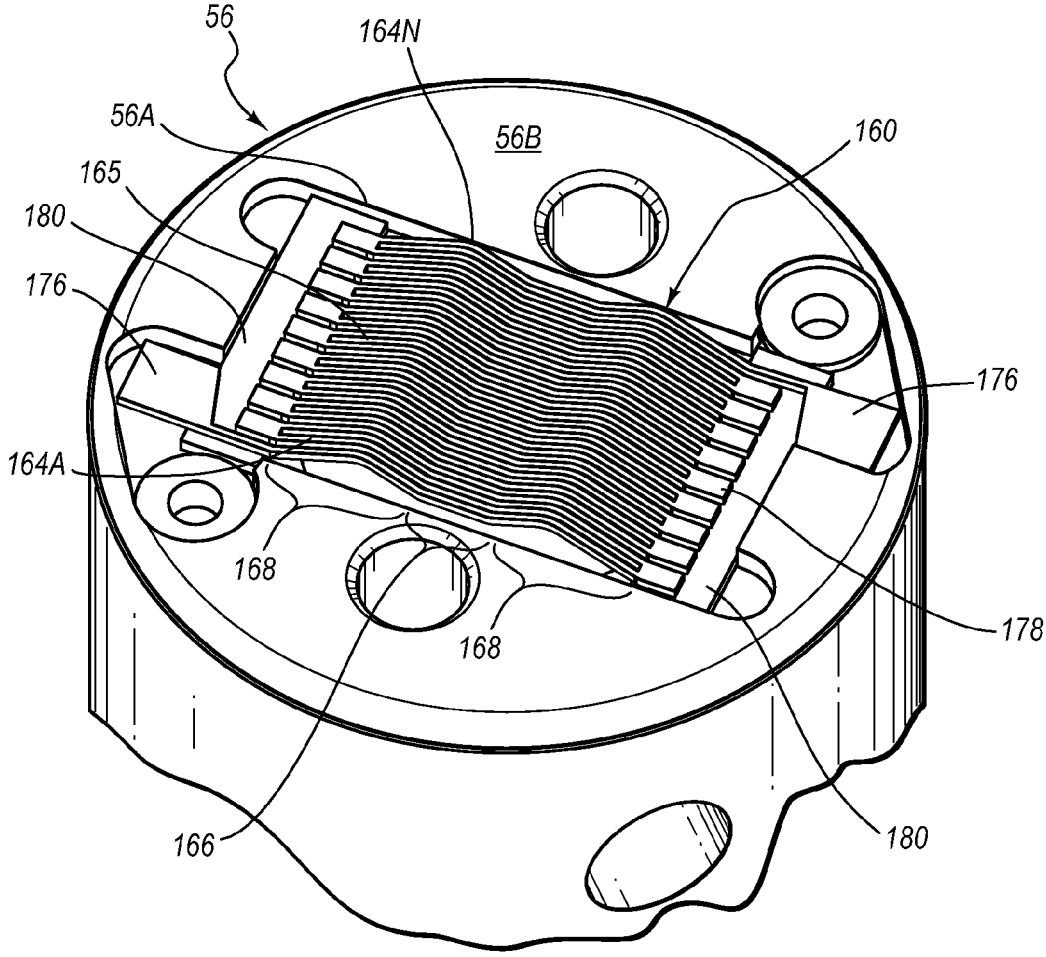
FIGS. 8A and 8B are perspective and side views, respectively, of a cathode head including a filament assembly according to another embodiment.

General reference is now made to FIGS. 8A-12. As mentioned above, the filament segments of the filament assembly can include other configurations that reside within the claims of the present invention. FIGS. 8A and 8B depict one possible example of this, wherein a filament assembly 160 is shown disposed in a cathode head 156. The filament assembly includes a plurality n of filament segments 164A, B, . . . , N as in previous embodiments, defined by an elongate conductive member 165. The filament assembly 160 is disposed in a cavity 56A defined in the surface 56A of the cathode head 56. So positioned, the filament assembly 160 is oriented to emit a stream of electrons when energized. Note that, though it is centrally located on the cathode head surface 56A, the filament assembly in other embodiments could be placed off-axis with respect to the cathode head center, if desired. This possibility exists with each of the embodiments described herein.

Figure 8B:
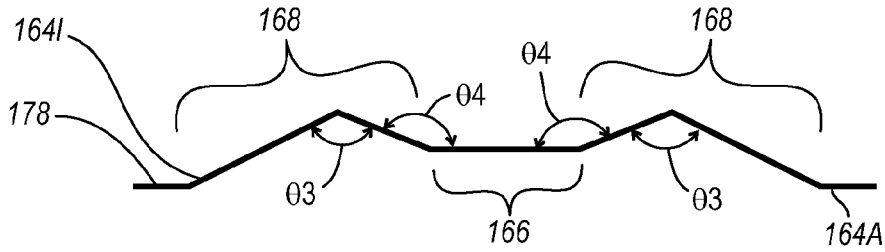

Each of the filament segments 164A-N is shaped in a particular configuration, best seen in FIG. 8B. As before, each filament segment 164A-N includes a central portion 166 configured to emit electrons during filament assembly operation, interposed between two adjacent end portions 168. At the perspective shown in FIG. 8B, the central portion 166 is relatively flat with respect to the cathode head surface 56B, while each of the end portions 168 is angled in a chevron shape, with the sides of each chevron defining an angle $\theta_3$, as shown in FIG. 8B. Each end portion chevron also defines an angle $\theta_4$ with the central portion 166. These angular configurations of the end portions 168 and their respective position with respect to the central portion 166 desirably provide a self-focusing effect for the electrons emitted from the central portion.

The filament segments 164A-N are interconnected with one another via a plurality of interconnections 178 so as to place the segments in electrical series with respect to one another. The two outer filament segments 164A and 164N are electrically connected with a respective terminal 176. Note that, though shown in electrical series here, the filament segments could alternatively be placed electrically in parallel, if desired.

The filament segment interconnections 178 are mounted on one of two thermally conductive insulators 180 that are disposed at opposite ends of the cathode head cavity 56A. This provides electrical isolation of the filament assembly 160 with respect to the cathode head 56 while enabling heat sinking of the filament assembly with respect to the cathode head.

Figure 9A:
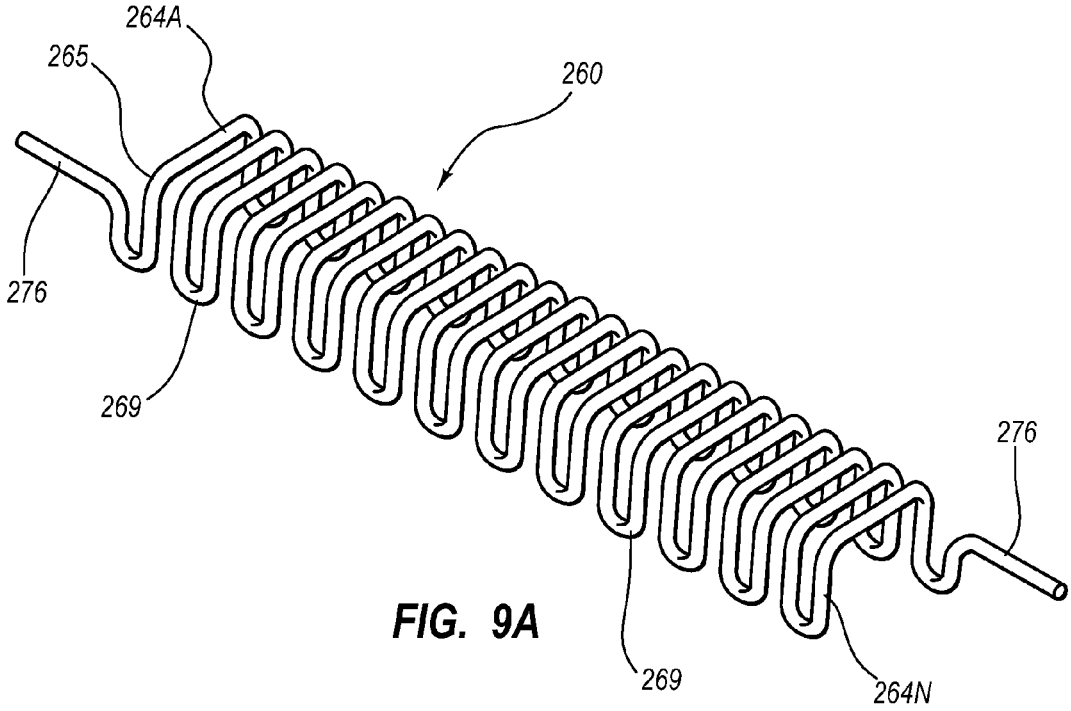
FIGS. 9A and 9B are perspective and close-up views, respectively, of a filament assembly configured according to yet another embodiment.
Figure 9B:
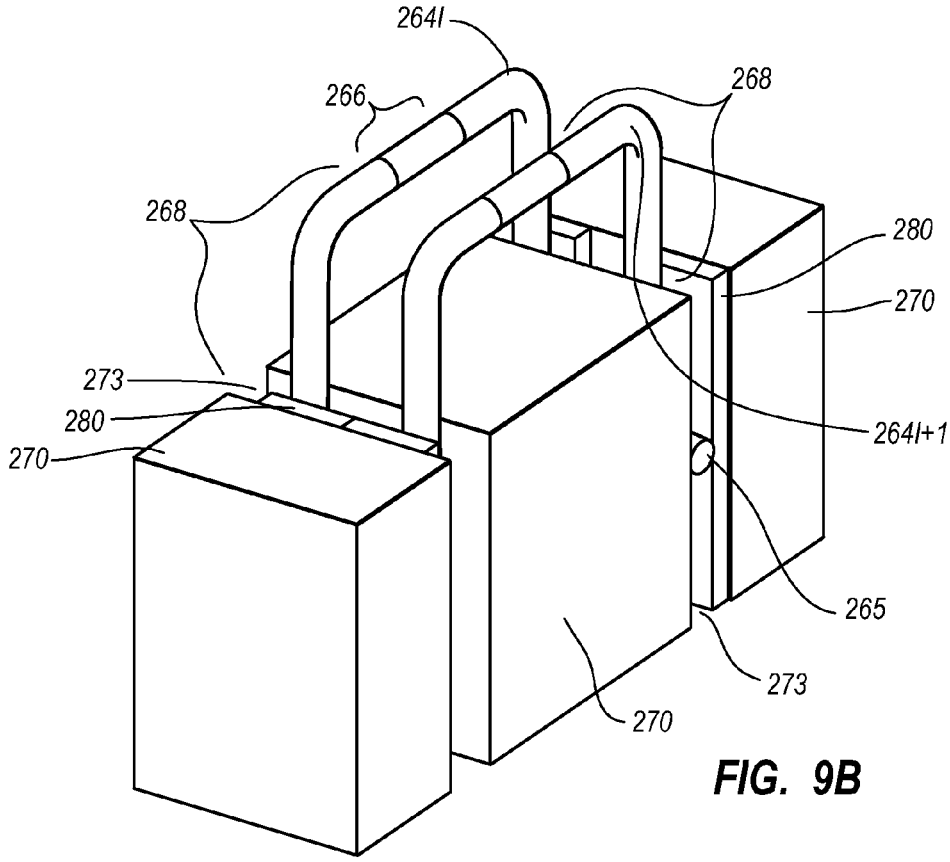

Reference is now made to FIGS. 9A and 9B in describing a filament assembly according to yet another embodiment of the present invention. In particular, a filament assembly 260 is shown, having a plurality of filament segments 264A, B, . . . , N integrally defined by an elongate conductive member 265, such as a thoriated tungsten wire, and arranged parallel to one another in a "ladder"-type configuration. As in previous embodiments, each filament segments 264A-N includes an electron-emitting central portion 266 bounded by two adjacent end portions 268. The filament segments 264A-N are interconnected to one another by bent interconnecting portions 269 of the conductive member 265. As such, the interconnecting portions are considered part of the filament segments 264. Each end of the conductive members 265 defines a terminal 276 for electrically connecting the filament assembly 260 to a power source (not shown).

As best seen in FIG. 9B, the filament assembly 260 is inserted into two slots 273 defined in a heat sink structure 270. The slots are sized so as to receive the interconnecting portions 269 and portions of the end portions 268 of each filament segment 264A-N. Thermally conductive insulators 280 are also included in the slots 273 to provide electrical isolation of the conductive member 265 and the heat sink structure 270. In this way, as in the other embodiments, each filament segment 264A-N is heat sunk to the heat sink structure 270, allowing for faster thermal time constant during cathode operation. Note that, though it is formed here as a single, integral wire here, the conductive member 265 in other embodiments can be configured as a plurality of joined elements.

Figure 10:
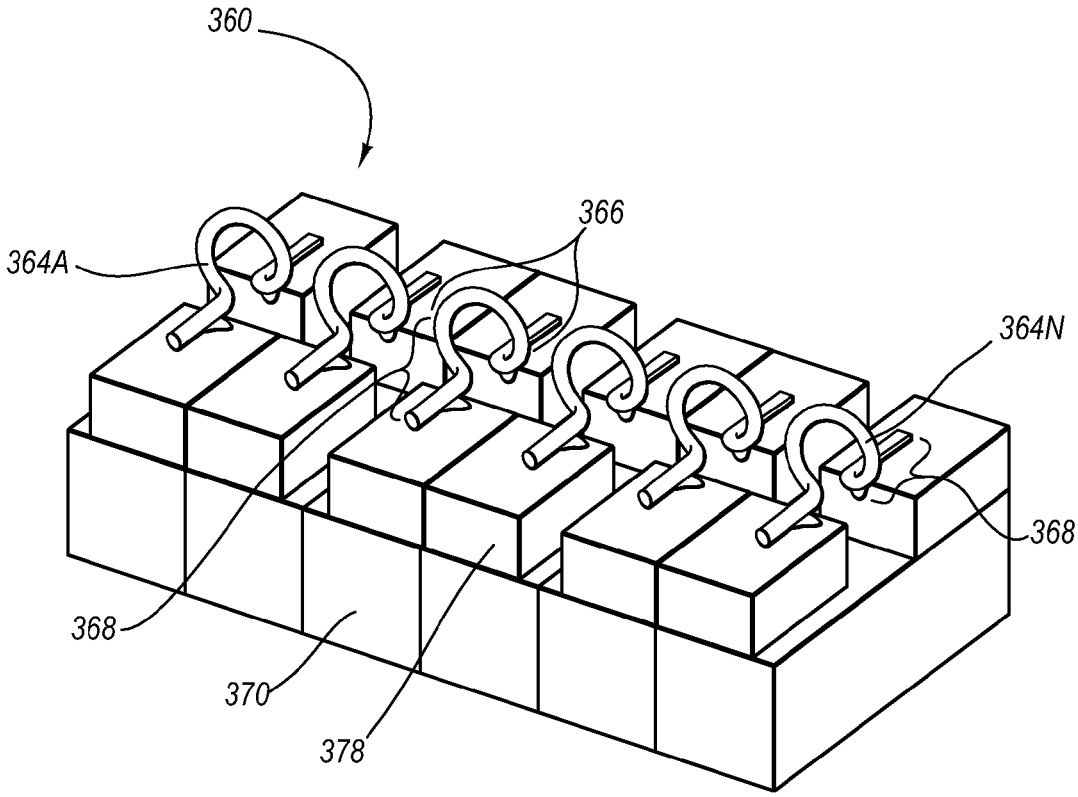
FIG. 10 is a perspective view of a filament assembly according to another embodiment.

FIG. 10 depicts yet another possible embodiment of a filament assembly, designated at 360, which includes a plurality of filament segments 364A-N each implemented as a single-turn filament coil. Each coiled filament segment 364A-N includes a central portion 366 primarily responsible for the emission of electrons during operation, which is bounded by adjacent end portions 368. A plurality of conductive interconnections 378 is included to electrically connect the filament segments 364A-N in series. The conductive interconnections 378 are thermally coupled to a heat sink 370 to enable relatively rapid heat removal from the filament segments 364A-N. As before, the filament segments can be electrically in series (as shown) or in parallel. In addition, any number of coils can define the central portion and/or end portions of each filament segment, as appreciated by one skilled in the art.

Reference is made to FIGS. 11A-11D in describing yet another possible embodiment of a filament assembly, generally designated at 460. The filament assembly 460 includes a plurality of filament segments 464A-464N defined from a continuous length of conductive material, such as a conductive wire 465, similar to the embodiment depicted in FIGS. 9A and 9B.

A heat sink/support structure ("heat sink") 470 is included with the filament assembly 460. The heat sink 470 is, in this particular example embodiment, configured as a multi-piece structure, including a central portion 470A that is laterally interposed between two outer portions 470B and 470C. The central and outer portions 470A-C defines a block structure that is disposed atop a base portion 470D.

Figure 11A:
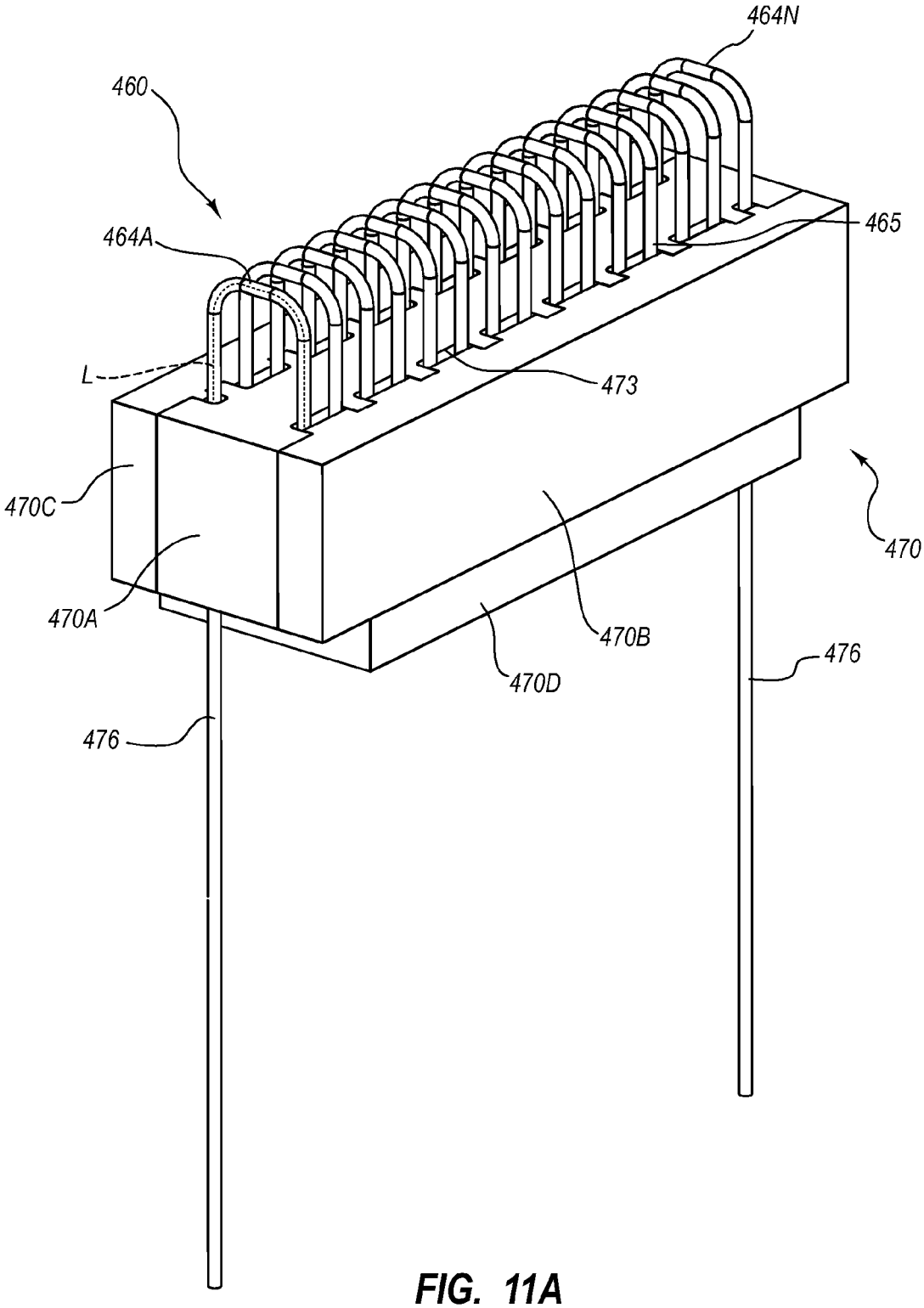
FIG. 11A is a perspective view of a filament assembly configured according to yet another embodiment of the present invention.
Figure 11B:
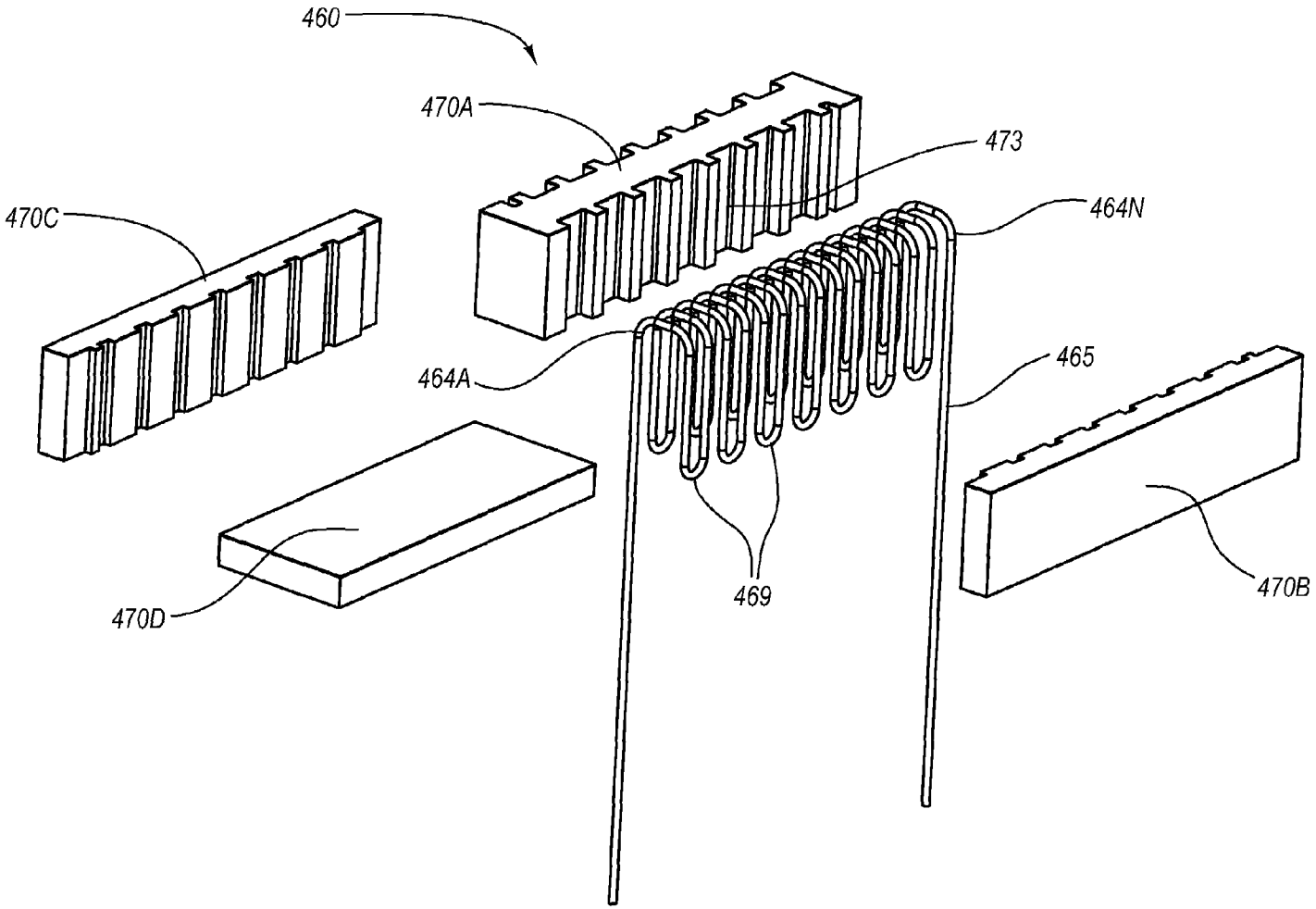
FIG. 11B is an exploded view of the filament assembly of FIG. 11A.
Figure 11C:
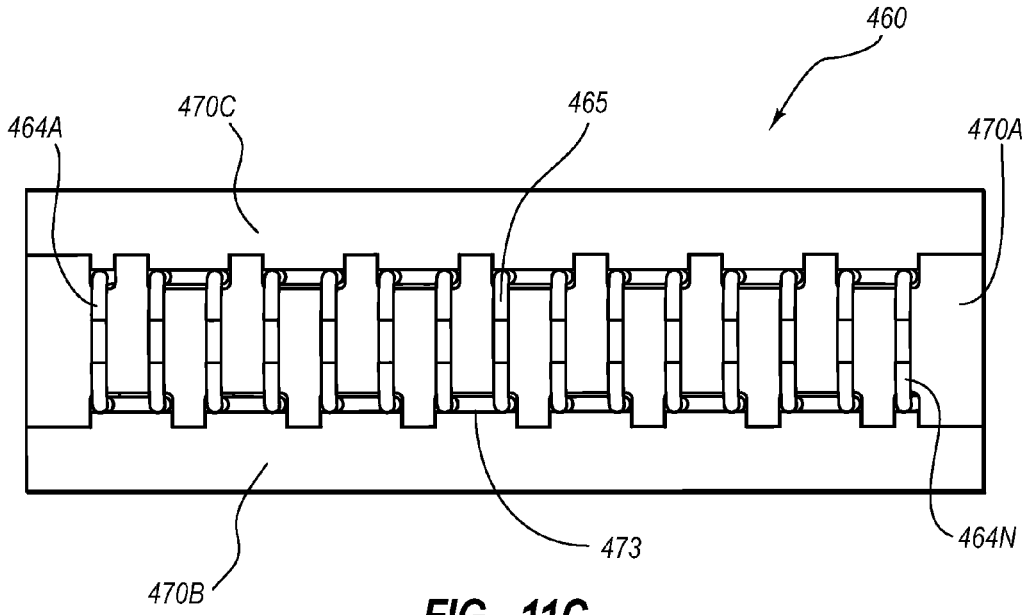
FIG. 11C is a top view of the filament assembly of FIG. 11A.
Figure 11D:
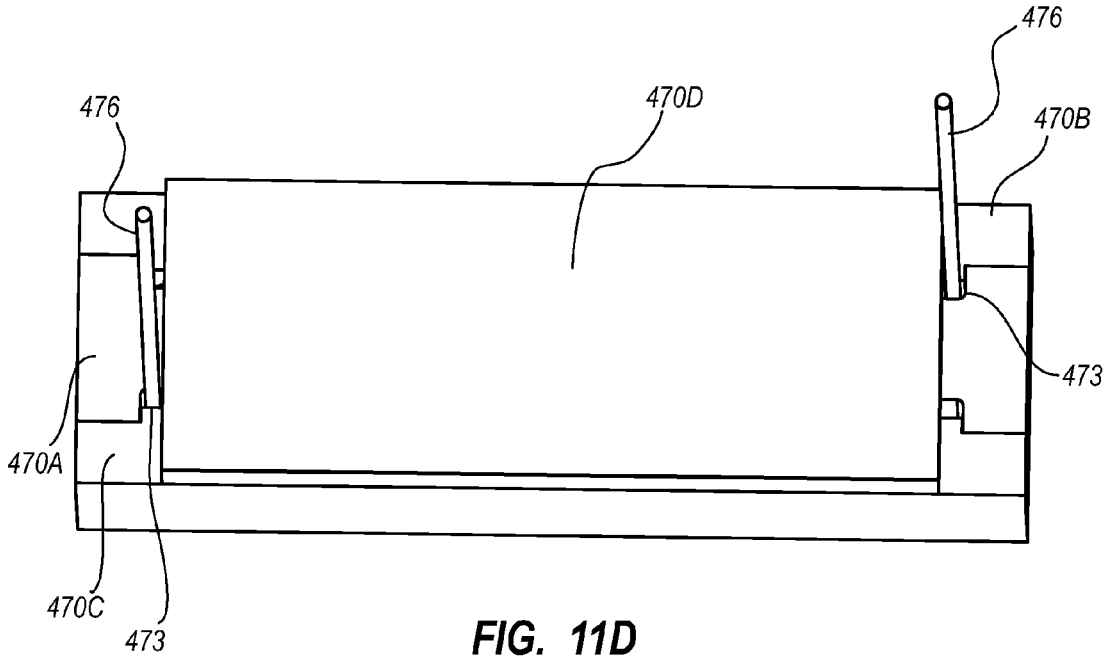
FIG. 11D is a bottom perspective view of the filament assembly of FIG. 11A.

The central portion 470A and outer portions 470B and 470C cooperate to define two rows of slots 473 through the heat sink 470. The slots 473 receive portions of the filament segments 464A-N so as to enable the segments to be partially inserted into the heat sink 470 in the manner shown in FIG. 11A such that the heat sink supports the filament in the desired position as shown in the figure. The slot 473 disposed at each terminal end of the slot rows is sized to a corresponding terminal 476 of the conductive wire 465 to pass through the heat sink 470 for electrically connecting the filament assembly to a suitable power source. This is best seen in FIGS. 11B and 11D The central portion 470A and outer portions 470B and 470C of the heat sink 470 in the present embodiment are composed of a material that both possesses electrically insulative properties and is thermally conductive. Such a material enables the conductive wire 465 to be electrically isolated while at the same time providing a suitable thermal path for the removal of heat from each filament segment 464A-N, as desired. In one example embodiment, for instance, the components of the heat sink 470 are composed of a thermally conductive and electrically insulating ceramic such as aluminum nitride, which offers the desired electrical insulation and thermal conductivity properties. Use of such a material enables the elimination of a separate electrical insulation component, seen at 280 in the embodiment depicted in FIGS. 9A-9B, for instance.

In another embodiment, the conductive material that forms the filament segments can be treated so as to include an exterior surface that is thermally conductive but electrically insulating. For example, the conductive wire that defines each of the filament segments in FIGS. 11A-11D and that is composed of a conductive material, such as thoriated tungsten, can be subjected to a ceramic cataphoresis procedure, which coats the exterior surface of the wire with a thin ceramic layer. This ceramic layer provides electrical isolation for the conductive wire and the filament segments it defines while preserving the ability of the segments to conduct heat to an electrically and/or thermally conductive heat sink, such as stainless steel or other metal.

Figure 12A:
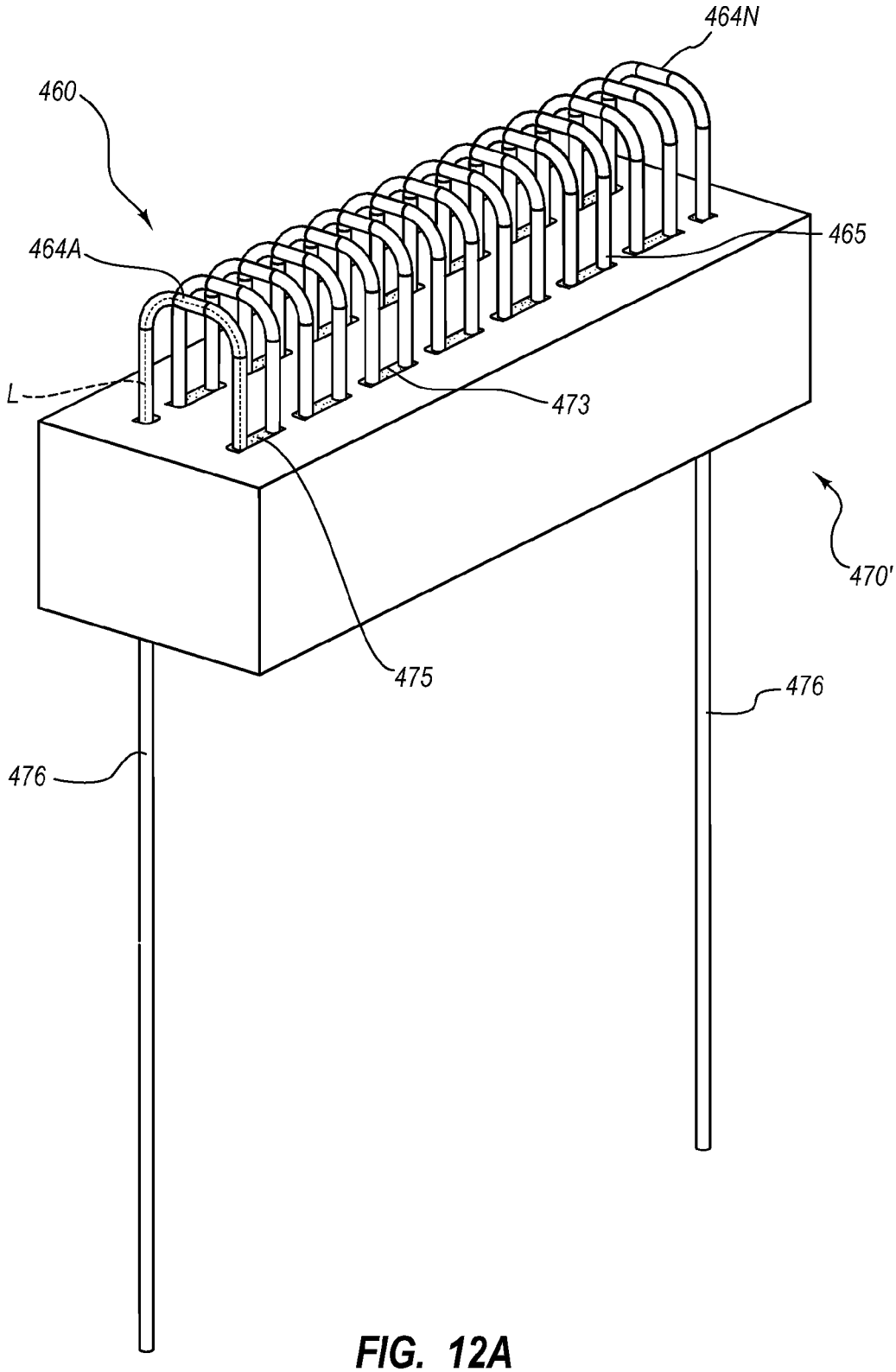
FIG. 12A is a perspective view of a filament assembly configured according to another example embodiment.

Note that fewer than all of the components of the heat sink 470 can be composed of aluminum nitride, if desired. Further note that, while shown here as a multi-piece component, the heat sink 470 in one embodiment can be defined as a single, integral piece. An example of this type of approach is shown in FIG. 12A, where heat sink 470 is formed as a single integral piece.

As mentioned in other embodiments, the filament segments 464A-N are interconnected to one another by bent interconnecting portions 469 of the conductive wire that defines the filament segments. In the illustrated embodiment the interconnecting portions 469, which are considered part of the filament segments, are in direct physical contact with, and therefore directly heat-sunk with, the heat sink 470. In contrast, the portion of each filament segment 464 of FIGS. 11A-11D that extends beyond the central portion 470A of the heat sink 470 is considered to be exposed, or not directly heat-sunk to the heat sink 470. This notwithstanding, each filament segment 464 defines a conductive thermal path to the heat sink via the end portions of each filament segment, which are continuously formed with the heat-sunk interconnecting portions 469. This arrangement enables heat from each filament segment to be transferred to the heat sink 470 primarily via conduction. The portion of each filament segment 464 shown in FIG. 11A that is exposed from the heat sink central portion 470 has a length that is indicated by "L" on FIG. 11A. Note that while each filament segment 464 shown in FIG. 11A is of equal length L, in other embodiments the filament segments can have respectively differing lengths, if desired.

One benefit of the filament assemblies disclosed herein in accordance with the various depicted embodiments is illustrated by the following equation:

$$P \propto 1/\sqrt{\tau} \tag{2}$$

where P is the power required to drive an exemplary filament segment and $\tau$ is the thermal time constant of the filament segment, as already mentioned. As equation (2) suggests, the power required to drive a filament segment of length L, such as any of the filament segments 464 shown in FIGS. 11A-11C, is inversely proportional to the square root of the thermal time constant, $\tau$. Thus as the thermal time constant $\tau$ is reduced by reducing filament segment length L (per equation (1)), the power P required to drive the filament segment is increased.

Though the dimensions can vary according to the particular application, in one embodiment each filament segment of the filament assembly 460 shown in FIGS. 11A-11D has a length L of approximately 300 mils, the conductive wire defining the filament segments has a diameter of approximately 7 mils, and the central portions of the filament segments are spaced a distance of 27 mils away from one another.

Figure 12B:
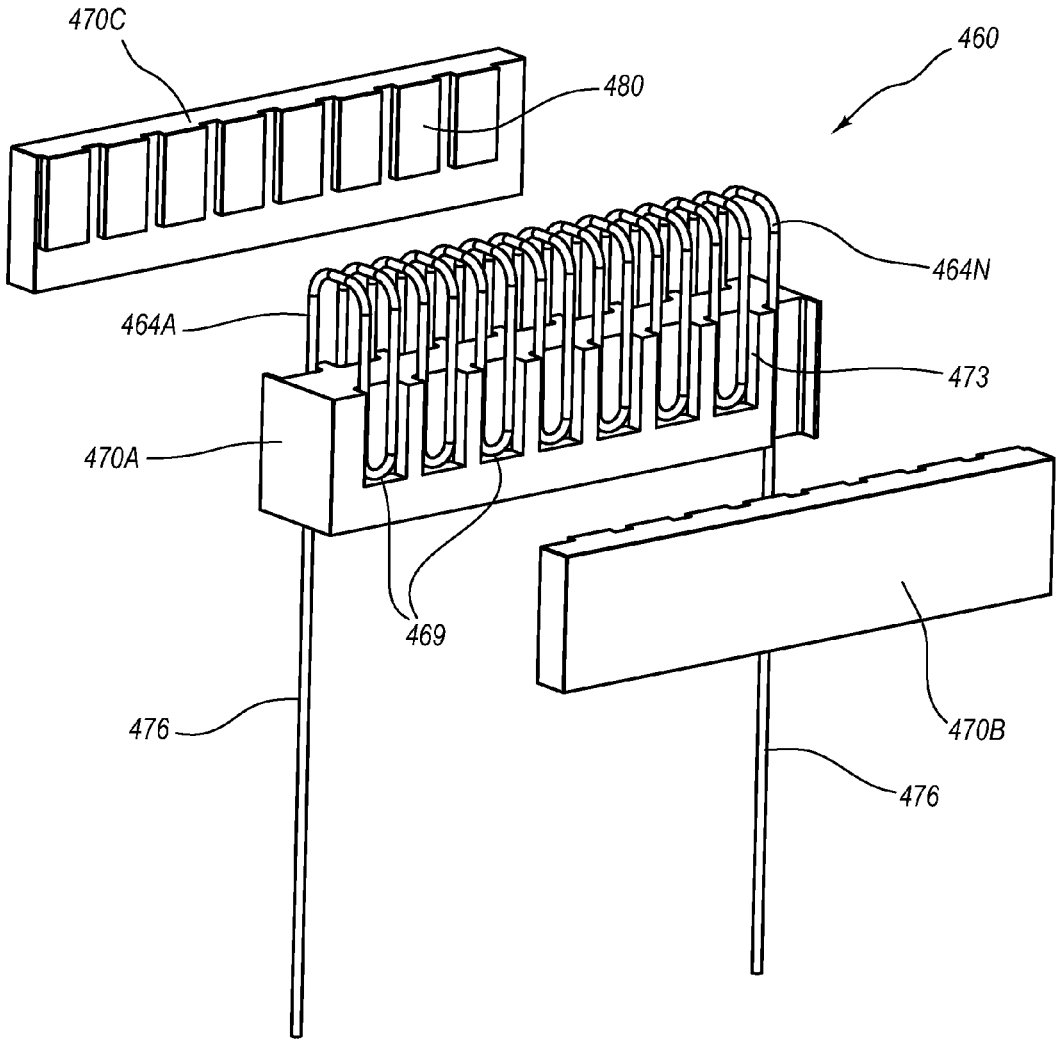
FIG. 12B is an exploded perspective view of a filament assembly configured according to yet another example embodiment.
Figure 13A:
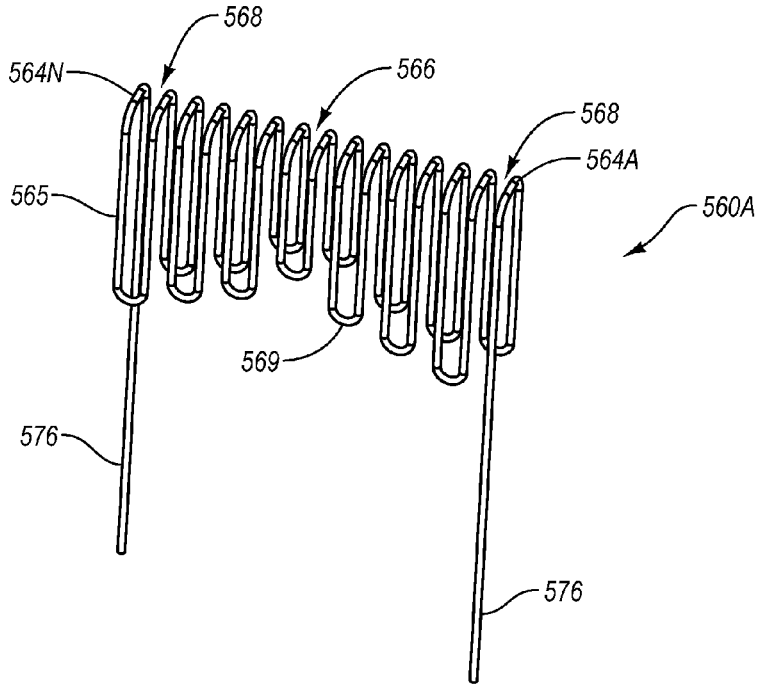
FIGS. 13A-13D are perspective, side, top and end views respectively of a filament assembly according to another embodiment.
Figure 13B:
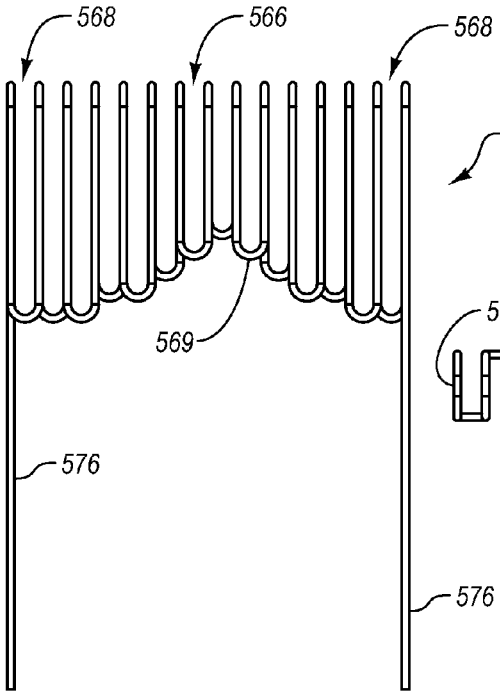
Figure 13C:
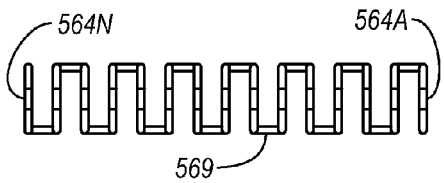
Figure 13D:
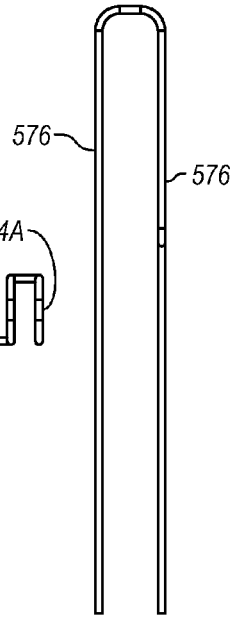
Figure 14A:
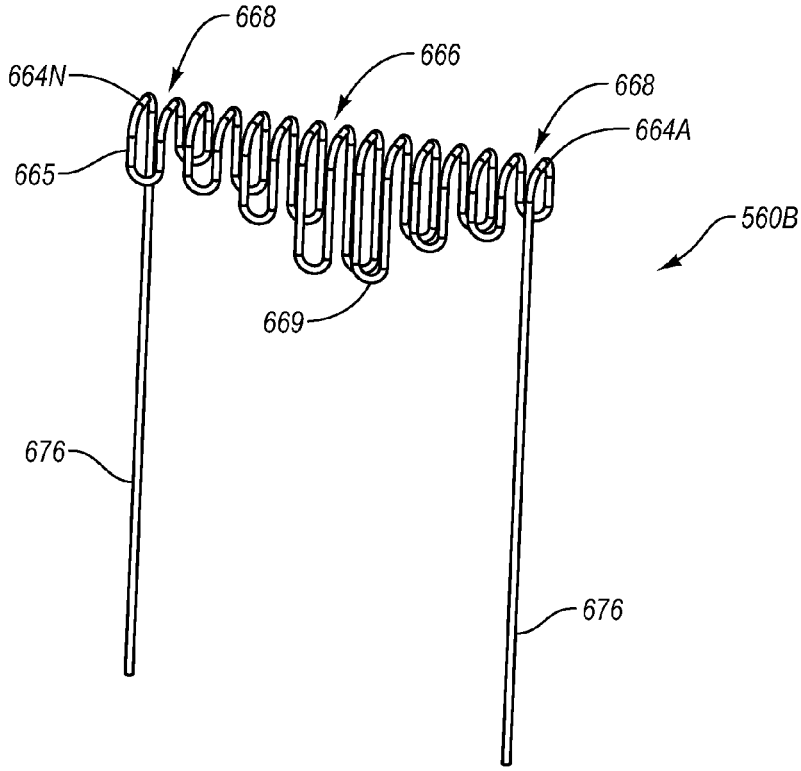
FIGS. 14A-14D are perspective, side, top and end views respectively of a filament assembly according to another embodiment.
Figure 14B:
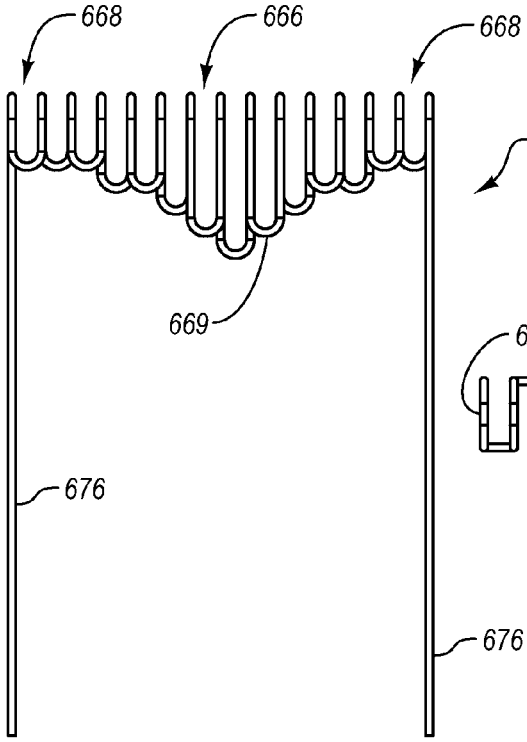
Figure 14C:
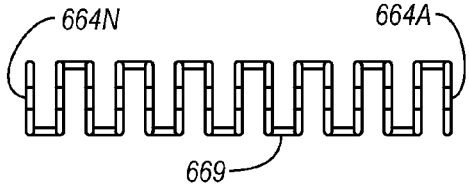
Figure 14D:
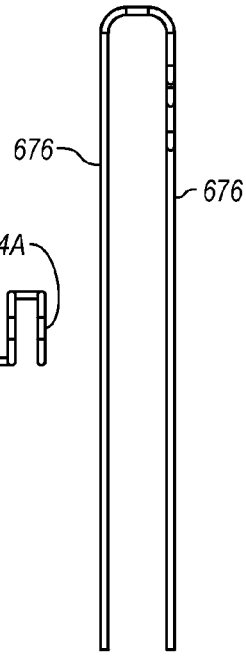

It is appreciated that the filament assembly configuration shown in FIGS. 11A-11D can be modified while still residing within the scope of embodiments of the present invention. For instance, FIG. 12B illustrates one such modification, wherein the central portion 470A of the filament assembly 460 is sized such that the slots 473 defined therein do not extend completely through the body, but rather extend only partially therethrough. This configuration enables the filament segments 464A-464N to seat within the corresponding slots 473. For example, the slots 473 shown in FIG. 12B extend about two-thirds the height of the central portion 470A. Note that each filament segment 464 in FIG. 12B extends above the central portion 470A a similar distance as extend the filament segments from the central portion in the embodiment shown in FIG. 11A. Of course, the amount of exposed filament segment can vary according to need or particular application.

The outer portions 470B and 470C in FIG. 12 each include a plurality of inset portions 480 that mate with the slots 473 to secure the filament wire therein when the outer portions are joined with the central portion. The filament wire can be brazed or otherwise suitably secured within the slots 473.

As noted above, portions of the filament segments are in physical contact with the heat sink so as to define a path of thermal communication between the filament segment and the heat sink. Alternative embodiments might utilize yet another thermally conductive material to enhance this thermal path. For example, in addition to utilizing a braze material to secure the filament wire within the slots, the braze material might be utilized to enhance the thermal conduction between a wire segment and the heat sink. One example approach is denoted in FIG. 12A. As is shown, slots 473 are substantially filled with a braze material, denoted at 475. In addition to securing the wire within the slot, the braze material increases the thermal contact between the wire and the heat sink, thereby enhancing the heat transfer from the wire to the heat sink. Preferably, the braze exhibits good thermal conductivity and is comprised of a material that doesn't adversely interact with the filament material. Further, the braze should preferably wet to ceramic (or whatever heat sink material is used) and should melt at high enough temperatures to keep solid during filament operation. For example, if a thoriated tungsten wire is used for the filament, a copper based braze might be used, such as Copper-ABA® braze from Wesgo®. Of course other suitable braze materials might also be used.

The shape and configuration of the filament segments can be modified from what is explicitly shown in FIGS. 11A-12. For instance, instead of a step ladder-type configuration, the filament segments in one embodiment can be angled or could even define a helix structure; in such a case, the slots of the heat sink are shaped as needed to receive predetermined portions of the helix-shaped conductive strand. Or, though shown here as defined by a single continuous wire, the filament segments of FIG. 12 can alternatively each be defined by separate wires electrically in parallel with one another. These and other possible modifications are therefore contemplated as being included within the principles of the present invention.

It should be further noted that, like those above, the embodiments discussed in connection with FIGS. 8A-12 can be configured so as to include filament assemblies having selected portions with altered work functions so as to preferentially emit electrons from the selected portions, as further described in the '975 application. For instance, the central portions of the filament segments shown in FIGS. 8A-8B, 9A-9B, and 10-12 can be modified so as to alter the work functions of their respective filament materials with respect to untreated portions of the filament segments. As discussed, this is performed with a view toward improving electron emission and overall filament segment performance during cathode operation.

Consistent with the above discussion, FIGS. 13-18 illustrate additional embodiments of the filament assemblies and heat sink structures. Again, these embodiments are all variations of the embodiments previously discussed, and provide alternate implementations to provide and achieve different thermal, power and/or electron density characteristics depending on the needs of a particular application.

Figure 15A:
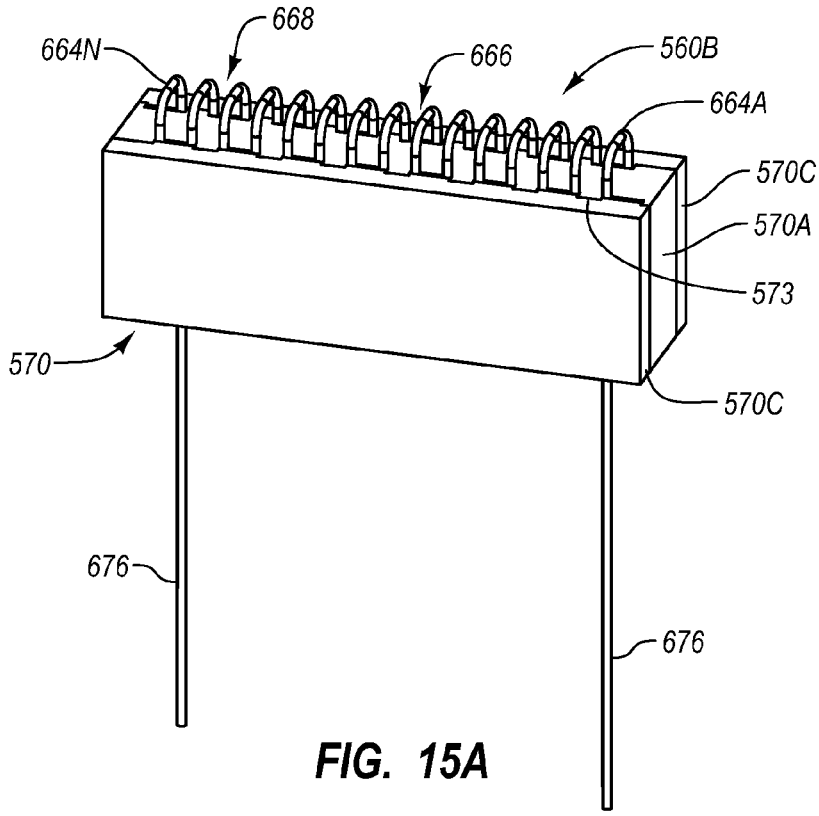
FIGS. 15A and 15B are additional perspective views of the filament assembly of FIG. 14.
Figure 15B:
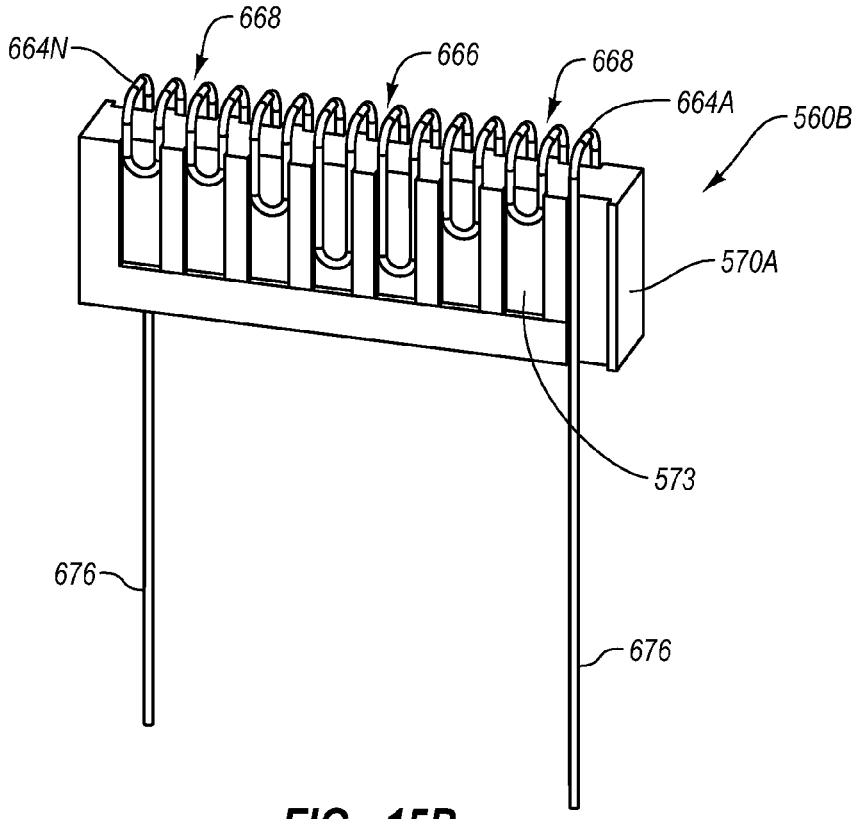
Figure 16A:
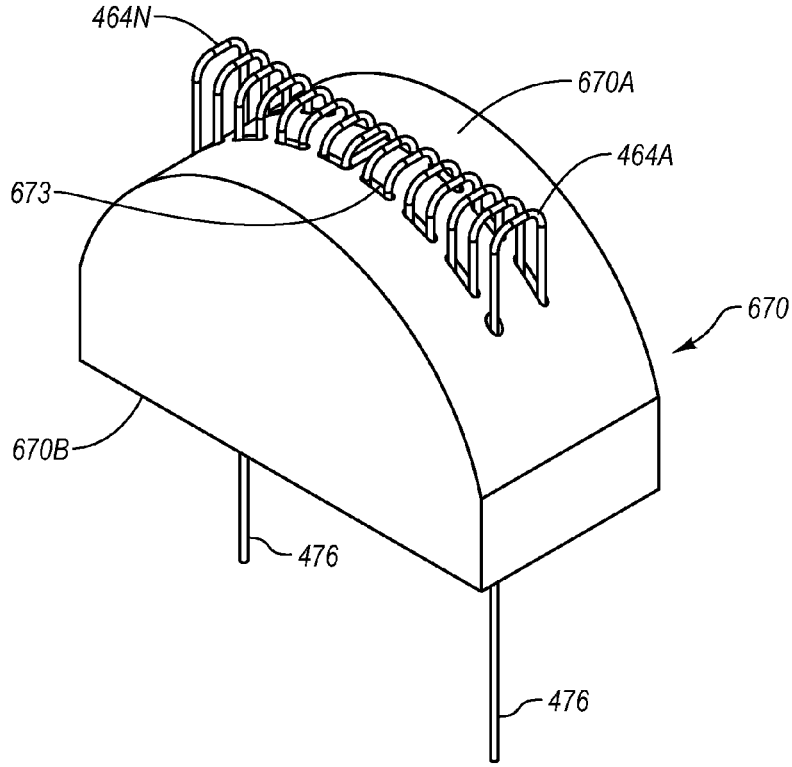
FIGS. 16A-16E are perspective, side, top and end views of a filament assembly with an alternative heat sink structure.
Figure 16B:
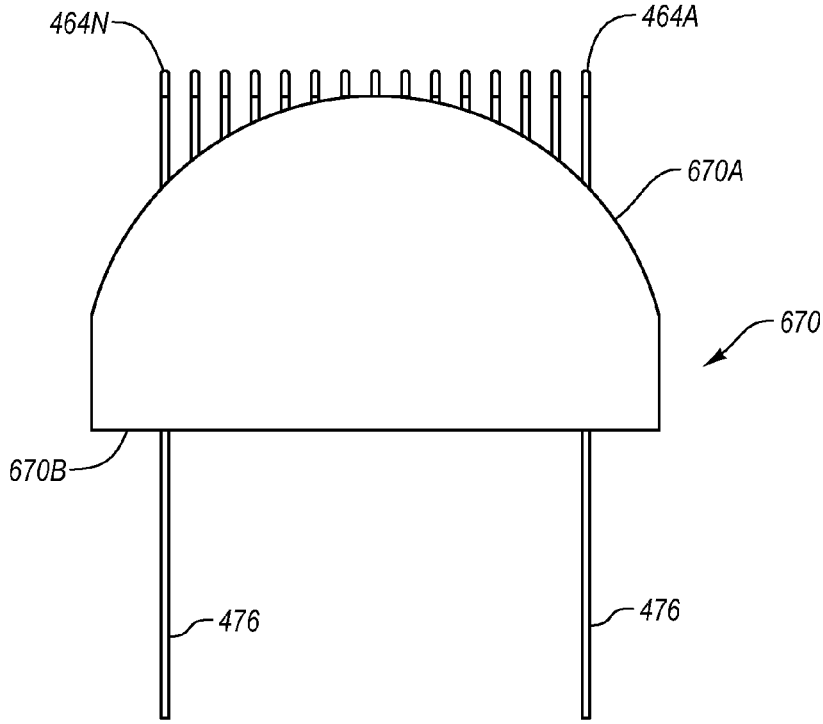
Figure 16C:
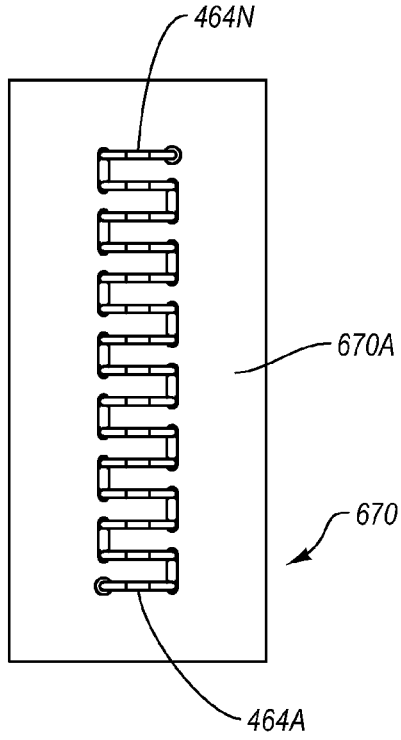
Figure 16D:
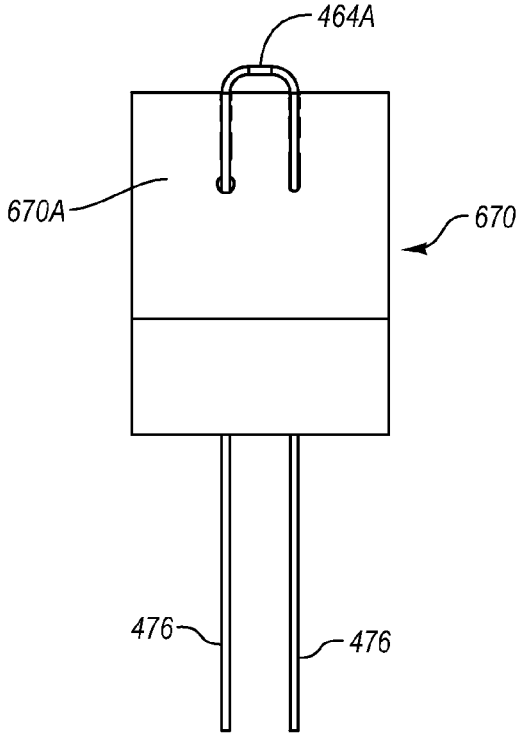
Figure 16E:
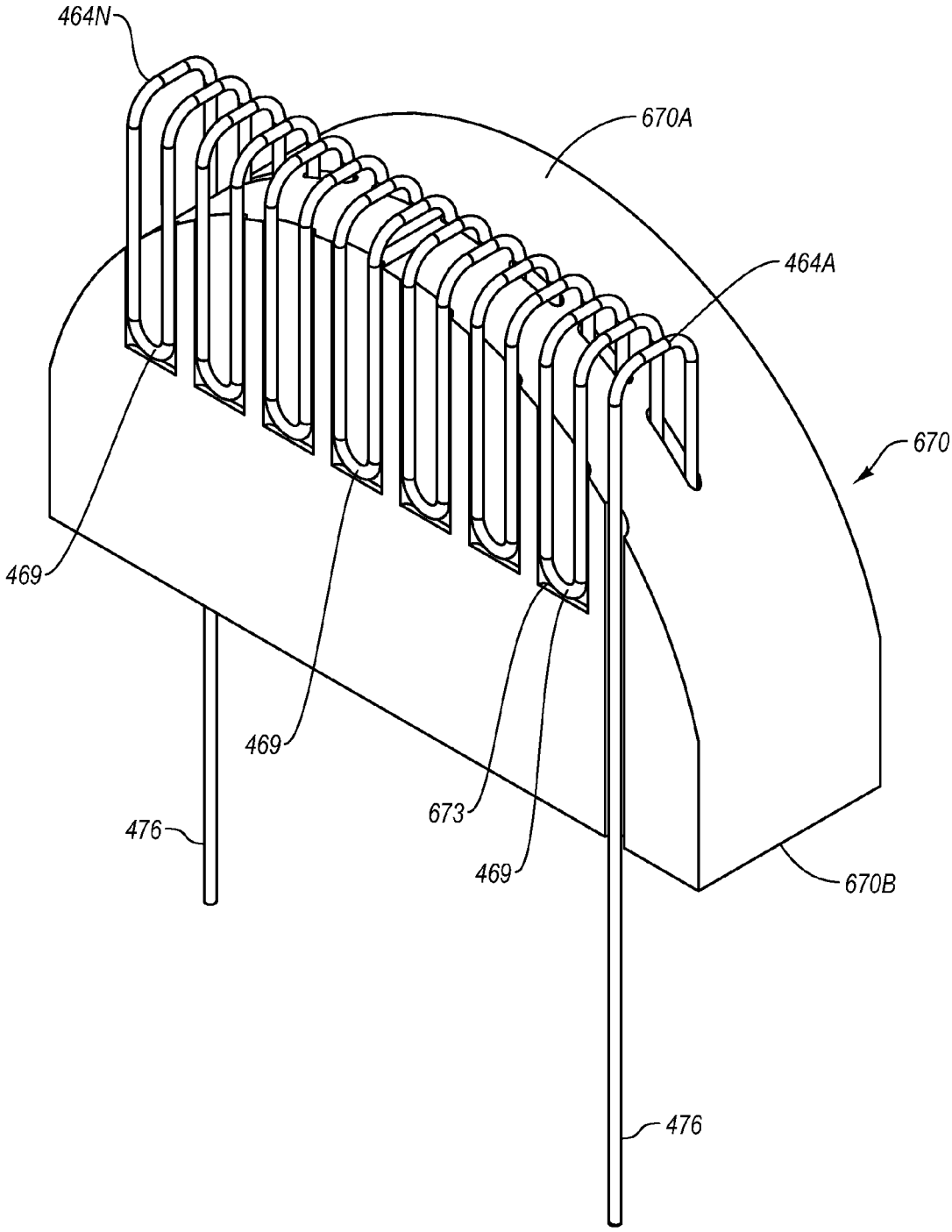
Figure 17A:
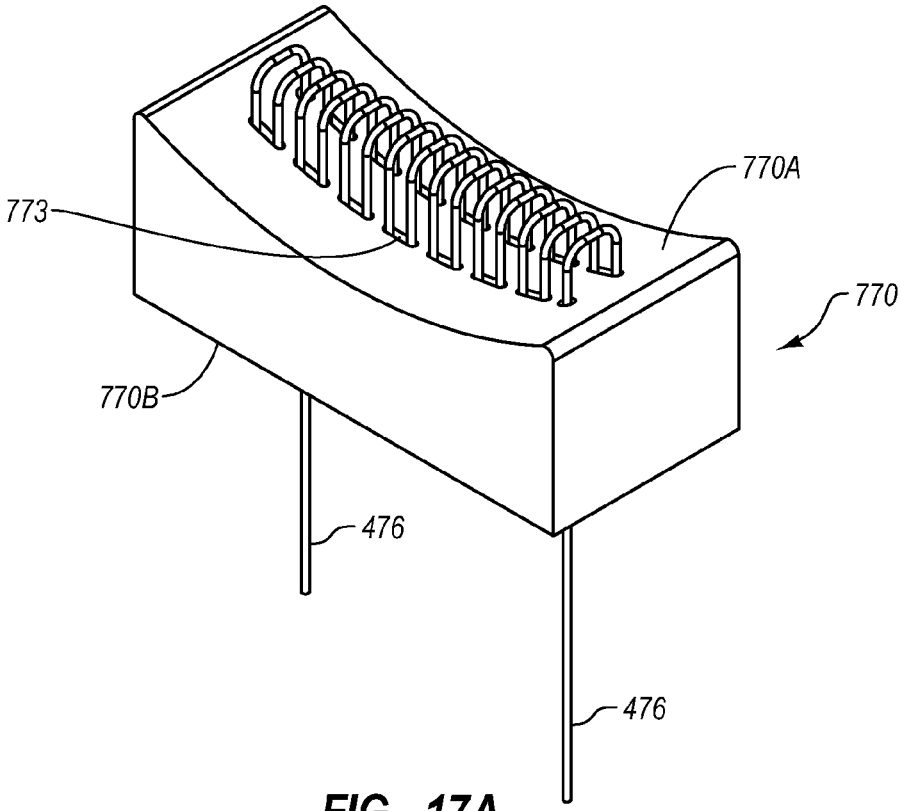
FIGS. 17A-17D are perspective, side, top and end views of a filament assembly with an alternative heat sink structure.
Figure 17B:
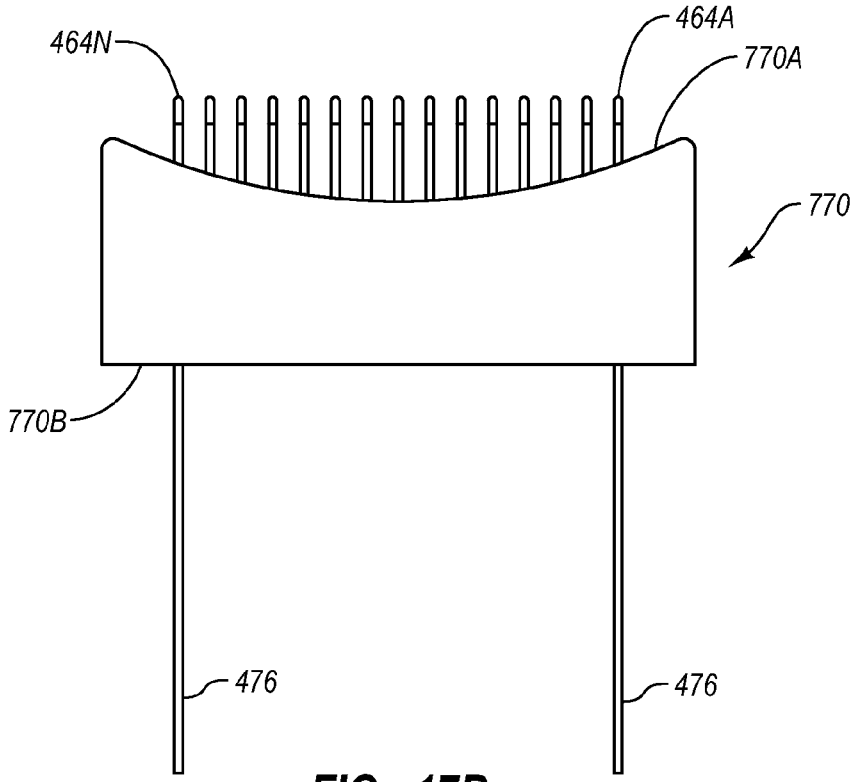
Figure 17C:
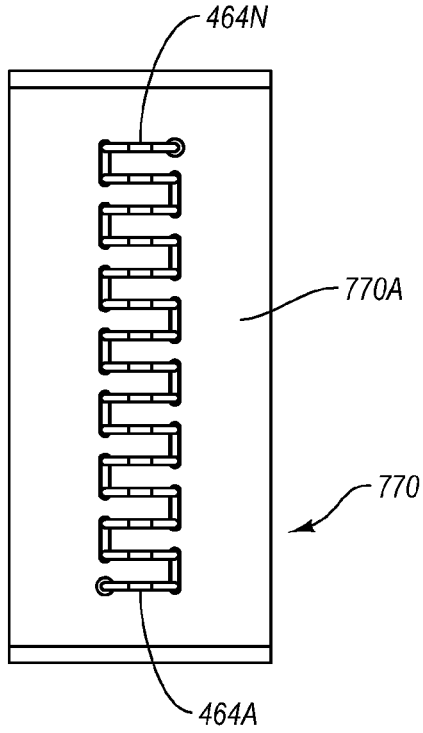
Figure 17D:
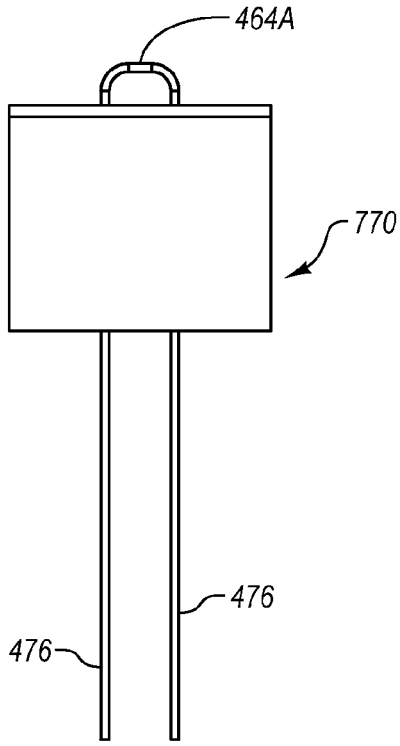
Figure 18A:
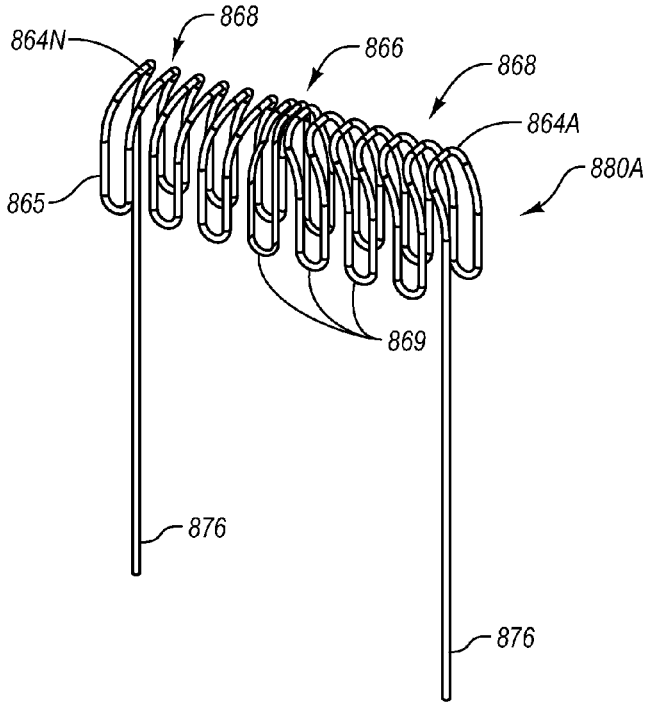
FIGS. 18A-18F are perspective, side, top and end views respectively of a filament assembly according to yet another embodiment.
Figure 18B:
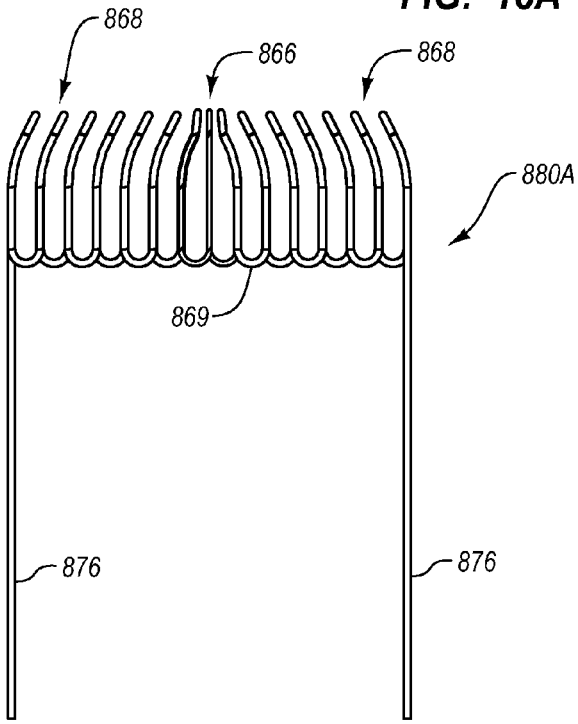
Figure 18C:
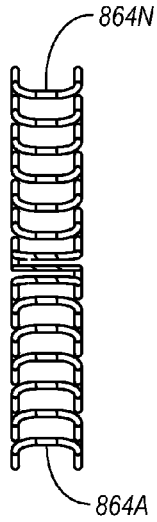
Figure 18D:
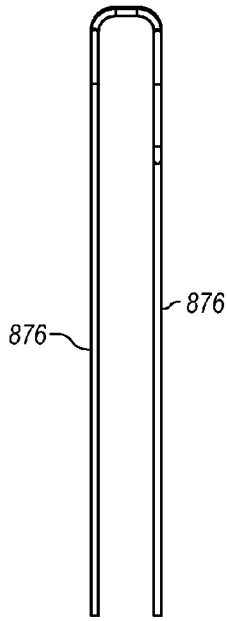
Figure 18E:
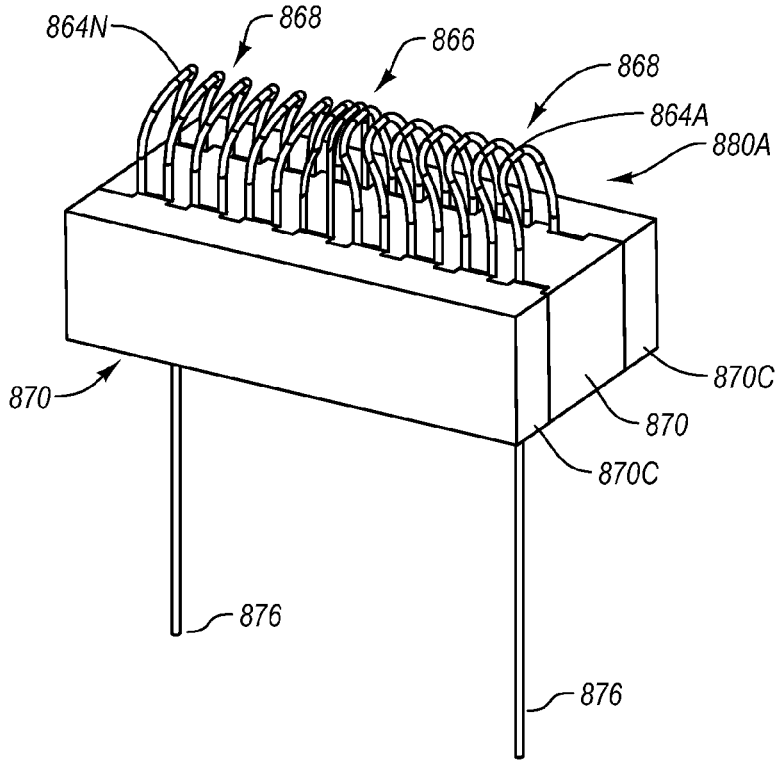
Figure 18F:
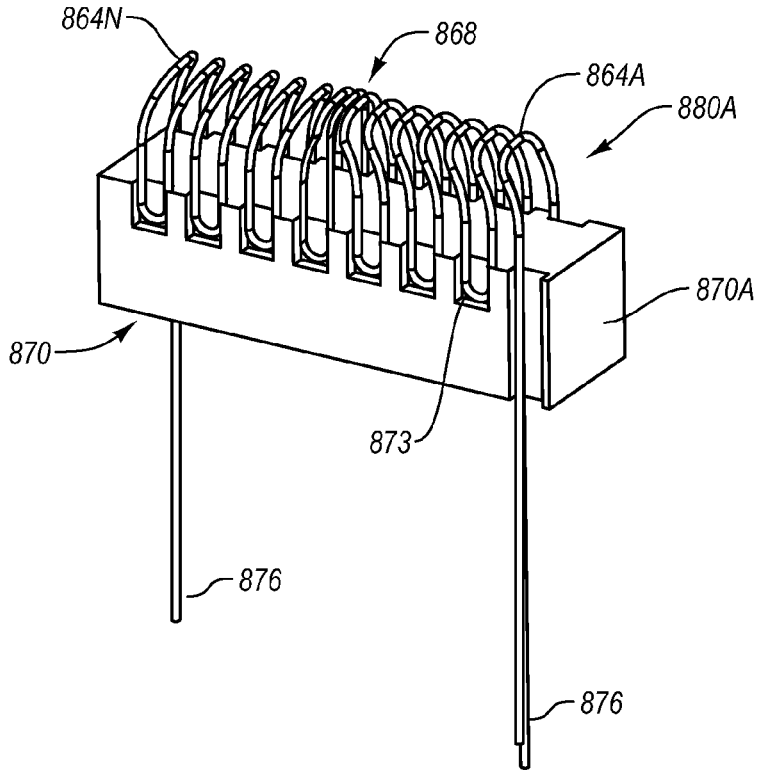

For example, the embodiments of FIGS. 13-15 illustrate how the conducting wire portions (565, 665 in these particular embodiments) of the filaments segments that are disposed within the slots of the heat sink (e.g., 570 in FIGS. 15A and 15B) have varying lengths with respect to one another. For example, in the embodiment of FIG. 13, the lengths at the end positions 568 are relatively longer as compared to the lengths in the central portion 566 of the filament assembly 560A. In contrast, in the filament assembly 560B of FIGS. 14 and 15, the lengths of the filaments segments in the region of the end positions 668 are relatively shorter, and increase towards the central portion 666. As will be appreciated, these different filaments assemblies can be used in connection with a heat sink structure similar to those previously discussed. For example, FIG. 15 illustrates how the filament assembly 560B of FIG. 14 might be used in connection with a heat sink designated generally at 570 that is similar to that described above in connection with FIG. 11. Those details will not be repeated here.

Also, as is shown in the embodiments of FIGS. 16-17, the shape of the heat sink portion can also be varied, again, depending on the needs of the particular thermal response and output power needed for a given application. For example, in the embodiment of FIG. 16, a filament assembly 464A (described above in connection with FIG. 11) might be functionally implemented with a heat sink having an alternate configuration, such as is shown at 670. As is illustrated in this example, the top surface 670A of heat sink 670 has an outwardly curved shape. Alternatively, as is shown in FIG. 17, a heat sink 770 might be implemented with a top surface 770A having an inwardly curved shape and configuration. Note that while these alternative heat sink configurations are shown with a particular filament assembly, that other assembly configurations could also be used, including for example, the configurations of FIGS. 13 and 14.

It will be further appreciated that the filament segments themselves may have alternate configurations, again, depending on the needs of a particular configuration. For example, to achieve different electron beam intensities, the filament segments might be oriented in different positions. One example of such an approach is shown in the embodiment of FIG. 18, wherein the filament segments are bent or angled. Here, the segments 864A . . . N are physically oriented towards the central portion 866 of the assembly. Again, this approach could also be combined with other configurations taught herein, such as the embodiments of FIGS. 13 and 14.

It is seen by the above discussion that the filament segments of the filament assemblies described herein serve as examples of plural means for simultaneously emitting a beam of electrons for impingement on the target surface of an anode. However, it should be remembered that the filament segment assemblies herein are only a few examples of such a plural means. Indeed, other structures, components, or assemblies could also serve as plural means for simultaneous electron emission while still residing within the scope of the present claims. As such, the present invention should not be limited to what is explicitly described and depicted herein.

In accordance with embodiments of the present invention, the filament assembly described herein enables relatively faster filament switching times to be achieved by lowering the thermal time constant of the filament. The use of multiple, relatively short filament segments increases the mechanical ruggedness of the filament assembly. Self-focusing configurations can be utilized to produce sharp beam profiles. If desired, thoriated filaments can be utilized more easily with the present design than with traditional filament designs. Further, the switching time improvement is achieved while controlling power dissipation and electrical impedance to within acceptable ranges.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube, comprising:

a vacuum enclosure;

an anode positioned within the vacuum enclosure and including a target surface; and a cathode positioned with respect to the anode, the cathode including a filament assembly comprising:

a plurality of filament segments each configured for simultaneous emission of a beam of electrons for impingement on the target surface of the anode, wherein each filament segment includes a thermal dissipation path to a heat sink.

2. The x-ray tube as defined in claim 1, wherein the heat sink is a portion of the cathode.

3. The x-ray tube as defined in claim 1, wherein the filament segments are electrically connected to one another in series.

4. The x-ray tube as defined in claim 1, wherein the filament segments are a electrically connected to one another in parallel.

5. The x-ray tube as defined in claim 1, wherein the filament segments control a thermal time constant for modifying the beam of electrons.

6. The x-ray tube as defined in claim 1, wherein the filament segments are configured so as to shape the beam of electrons in a predetermined manner.

7. The x-ray tube as defined in claim 1, wherein the filament segments are arranged substantially parallel to one another between first and second heat sinks.

8. The x-ray tube as defined in claim 1, wherein each of the filament segments are of substantially equal length.

9. The x-ray tube as defined in claim 1, wherein each of the filament segments includes:

first and second end portions that each define at least a portion of the thermal dissipation path to the heat sink; and a central portion interposed between the end portions, the central portion configured for emitting electrons.

10. The x-ray tube as defined in claim 9, wherein the central portion is flat, and wherein each end portion is angled with respect to the central portion.

11. The x-ray tube as defined in claim 10, wherein each end portion defines a chevron shape.

12. The x-ray tube as defined in claim 9, wherein the central portions of the filament segments are parallel with one another and are each rectilinear, and wherein the end portions of each filament segment are L-shaped.

13. The x-ray tube as defined in claim 1, wherein the filament segments are composed of a single continuous conductive element, and wherein the filament segments are interconnected by U-shaped interconnecting portions of the continuous conductive element.

14. The x-ray tube as defined in claim 13, wherein the interconnecting portions are received into slots defined in the heat sink.

15. The x-ray tube as defined in claim 9, wherein the first, second and end portions of each filament segment are included on a helical coil of a conductive element.

16. The x-ray tube as defined in claim 9, wherein the central portions of the filament segments are linearly aligned in a row parallel to one another.

17. The x-ray tube as defined in claim 1, wherein the filament segments are comprised of thoriated tungsten.

18. The x-ray tube as defined in claim 1, wherein the filament segments are comprised of lanthanated tungsten.

19. The x-ray tube as defined in claim 1, wherein the thermal dissipation path is at least partially defined with a braze material.

20. In an x-ray tube, a filament assembly, comprising:

at least a first heat sink; and a plurality of filament segments each thermally connected to the at least first heat sink, the filament segments configured to simultaneously emit a beam of electrons.

21. The filament assembly as defined in claim 20, wherein the filament segments are parallel to one another, and wherein the filament segments have parallel thermal dissipation paths.

22. The filament assembly as defined in claim 20, wherein each filament segment includes a central portion interposed between two end portions.

23. The filament assembly as defined in claim 22, wherein the central portion is modified so as to preferentially emit a portion of the beam of electrons.

24. The filament assembly as defined in claim 22, wherein each end portion is thermally connected to the at least first heat sink via conduction.

25. The filament assembly as defined in claim 20, further comprising:

a first thermally conductive electrical insulator interposed between the first heat sink and the filament segments; and a second thermally conductive electrical insulator interposed between a second heat sink and the filament segments.

26. The filament assembly as defined in claim 20, wherein each filament segment is a wire having a round cross section and defining a plurality of helical coils, and wherein at least one coil of each filament segment emits electrons.

27. The filament assembly as defined in claim 20, wherein each filament segment defines a central portion having at least one coil and two end portions each defining at least one coil.

28. The filament assembly as defined in claim 20, wherein at least some of the filament segments are comprised of tungsten.

29. The filament assembly as defined in claim 28, wherein the tungsten is thoriated.

30. The filament assembly as defined in claim 20, wherein at least a portion of the filament segments comprise means for modifying the work function of the filament segment.

31. The filament assembly as defined in claim 30, wherein the means for modifying comprises a carburized portion.

32. The filament assembly as defined in claim 20, wherein the thermal connection is provided as least partially via a braze material.

33. The filament assembly as defined in claim 20, wherein at least a portion of the filament segments are disposed within slots formed within the heat sink.

34. The filament assembly as defined in claim 33, wherein the slots are at least partially filled with a braze material.

35. The filament assembly as defined in claim 34, wherein the braze material is copper based.

36. An x-ray tube, comprising:

a vacuum enclosure;

an anode positioned within the vacuum enclosure and including a target surface; and a cathode positioned with respect to the anode, the cathode including:

a filament assembly, comprising:

a heat sink;

a plurality of filament segments configured for simultaneous emission of a beam of electrons for impingement on the target surface of the anode, the filament segments being electrically connected in series, wherein each filament segment includes:

first and second end portions, the end portions being thermally connected to the heat sink; and a central portion interposed between the first and second end portions, the central portion having a modified work function for preferentially emitting electrons.

37. The x-ray tube as defined in claim 36, wherein the plurality of filament segments are electrically connected in series via a plurality of conductive interconnects.

38. The x-ray tube as defined in claim 37, further comprising thermally conductive insulators that are interposed between the heat sink and the conductive interconnects to electrically isolate the conductive interconnects from the first and second heat sinks.

39. The x-ray tube as defined in claim 38, wherein the first and second end portions are angled with respect to the central portion.

40. The x-ray tube as defined in claim 39, wherein at least one of the filament segments is composed of thoriated tungsten.

41. The x-ray tube as defined in claim 40, wherein at least a portion of at least some of the filament segments are carburized so as to modify the work function of the corresponding portion of the filament segment.

42. The x-ray tube as defined in claim 41, wherein each filament segment is of substantially equal length and configuration.

43. The x-ray tube as defined in claim 36, wherein the thermal connection between the first and the second end portions and the heat sink is at least partially provided by way of a braze material.

44. The x-ray tube as defined in claim 36, wherein the first and second end portions of each filament segment are interconnected via interconnecting portions, and wherein at least a portion of each of the interconnecting portions are received within slots formed within the heat sink.

45. The x-ray tube as defined in claim 44, wherein the slots are at least partially filled with a braze material.

46. The x-ray tube as defined in claim 45, wherein the braze material is copper based.

47. A filament assembly, comprising:

a heat sink defining a plurality of slots;

a plurality of filament segments configured for simultaneous emission of a beam of electrons, wherein a portion of each filament segment is disposed within a corresponding at least one of the slots, and wherein each filament segment includes:

first and second end portions, the end portions being thermally connected to the heat sink; and a central portion interposed between the first and second end portions.

48. The filament assembly as defined in claim 47, wherein the plurality of filament segments is defined by a continuous strand of conductive wire such that the filament segments are electrically connected in series.

49. The filament assembly as defined in claim 47, wherein the filament segments are electrically connected in parallel.

50. The filament assembly as defined in claim 47, wherein the heat sink is composed of an electrically insulative and thermally conductive material.

51. The filament assembly as defined in claim 50, wherein the heat sink is composed of a ceramic.

52. The filament assembly as defined in claim 50, wherein the heat sink is composed of aluminum nitride.

53. The filament assembly as defined in claim 50, wherein the heat sink further comprises a composite structure having a central portion, two outer portions, and a base portion on which the central and outer portions are disposed.

54. The filament assembly as defined in claim 47, wherein the slots of the heat sink extend completely through the heat sink body.

55. The filament assembly as defined in claim 48, wherein adjacent filament segments are interconnected by interconnecting portions of the conductive wire, each interconnecting portion being physically connected to a portion of the heat sink.

56. The filament assembly as defined in claim 48, wherein the conductive wire is coated with an insulating layer so as to electrically insulate the conductive wire from the heat sink.

57. The filament assembly as defined in claim 56, wherein the insulating layer is composed of a ceramic material.

58. The filament assembly as defined in claim 47, wherein the portion of each filament segment that extends from the corresponding at least one of the slots has a uniform length.

59. The filament assembly as defined in claim 47, wherein the slots are at least partially filled with a braze material.

* * * * *

UNITED STATES PATENT AND TRADEMARK OFFICE

CERTIFICATE OF CORRECTION

PATENT NO. : 7,539,286 B1
APPLICATION NO. : 11/942656
DATED : May 26, 2009
INVENTOR(S) : Bandy et al.

It is certified that error appears in the above-identified patent and that said Letters Patent is hereby corrected as shown below:

Column 6
Line 16, change the 2nd "64C" to --64D--

Column 7
Line 14, change "for each for each" to --for each--

Column 10
Line 15, change "156" to --56--

Signed and Sealed this

Twenty-third Day of February, 2010

David J. Kappos

David J. Kappos
*Director of the United States Patent and Trademark Office*